US006046756A

United States Patent [19]

Iga et al.

[11] Patent Number: 6,046,756

[45] **Date of Patent: *Apr. 4, 2000**

[54] PRINTER DEVICE

[75] Inventors: Kaname Iga; Satoshi Kitahara, both of Shizuoka-ken; Hiroyasu Ishii, Numazu; Kazuhiro Fushimi, Mishima; Takashi Ichikawa; Hidemi Mihara, both of Shizuoka-ken, all of Japan

[73] Assignee: Toshiba Tec Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,708

[22] Filed: Sep. 27, 1996

[30] Foreign Application Priority Data

Sep. 29, 1995 [JP] Japan ..... 7-254190
Oct. 17, 1995 [JP] Japan ..... 7-268453

[51] Int. Cl.[7] ..... B41J 2/32

[52] U.S. Cl. ..... 347/173

[58] Field of Search ..... 347/171, 172, 347/173, 175, 177; 400/120.02

[56] References Cited

U.S. PATENT DOCUMENTS

| | | | |
|---|---|---|---|
| 4,694,305 | 9/1987 | Shiomi et al. . | |
| 4,940,993 | 7/1990 | Sato | 347/173 |
| 5,069,562 | 12/1991 | Matsuda | 400/630 |
| 5,486,057 | 1/1996 | Skinner et al. | 400/120.02 |
| 5,492,061 | 2/1996 | Park et al. | 101/486 |
| 5,505,550 | 4/1996 | Kitahara et al. | 400/618 |

FOREIGN PATENT DOCUMENTS

| | | |
|---|---|---|
| 0050481 A2 | 4/1982 | European Pat. Off. . |
| 0673776 A1 | 9/1995 | European Pat. Off. . |
| 2263086 | 7/1993 | United Kingdom . |

OTHER PUBLICATIONS

Patent Abstracts of Japan, vol. 11, No. 310 (M–630), Jan. 9, 1987 & JP 62 097872 A (Seiko Epson Corp.), May 7, 1987.

Patent Abstracts of Japan, vol. 13, No. 193 (M–822) '3541!, May 9, 1989 & JP 01 016671 A (Canon Inc.), Jan. 20, 1989.

Patent Abstracts of Japan, vol. 14, No. 501 (M–1043), Nov. 2, 1990 & JP 02 206575 A (Matsushita Electric Ind., Co.), Aug. 16, 1990.

Patent Abstracts of Japan, vol. 9, No. 3, (M–349), Jan. 9, 1985 & JP 59 155085 A (Tokyo Denki KK), Sep. 4, 1984.

Patent Abstracts of Japan, vol. 007, No. 081 (M–205), Apr. 5, 1983 & JP 58 007393 A (Daini Seikosha KK), Jan. 17, 1983.

(List continued on next page.)

*Primary Examiner*—N. Le
*Assistant Examiner*—Anh T. N. Vo
*Attorney, Agent, or Firm*—Frishauf, Holtz, Goodman, Langer & Chick, P.C.

[57] ABSTRACT

A color printer includes a plurality of platens arranged on paper feeding path to feed paper on which a plurality of printing areas are arranged in series, a plurality of print heads arranged on the feeding path to face the platens to print data on the same printing areas of the paper fed on the feeding path, a feeding roller for feeding, to the print heads, the paper along the feeding path, a front-edge sensing section disposed between the feeding roller and a print head nearest the feeding roller to detect that the paper has been positioned at a printing start position, and a plurality of head lift mechanisms for setting the print heads from the platens to a standby position apart from the platens before the paper is fed to the printing start position and to a contact position at which the print heads come in contact with the platens after the paper has been fed to the printing start position. Particularly, the color printer has an engine controller for sequentially driving the head lift mechanisms to set the print heads to the contact position when the front edge of the paper has reached positions slightly advanced over the print heads.

16 Claims, 15 Drawing Sheets

OTHER PUBLICATIONS

Patent Abstracts of Japan, vol. 010, No. 234 (M–507), Aug. 14, 1986 & JP 61 068270 A (Fuji Xerox Co., Ltd.), Apr. 8, 1986.

Patent Abstracts of Japan, vol. 012, No. 416 (M–759), Nov. 4, 1988 & JP 63 154374 A (Fujitsu Ltd.), Jun. 27, 1988.

Patent Abstracts of Japan, vol. 014, No. 432 (M–1026), Sep. 17, 1990 & JP 02 171254 A (NEC Corp.), Jul. 17, 1990.

PRINTER DEVICE

BACKGROUND OF THE INVENTION

1. Field of the Invention

The present invention relates to a printer device having a plurality of print heads arranged on a feeding path of paper, and more particularly to a printer device in which each print head is driven while pressing the paper against a platen.

2. Description of the Related Art

A thermal transfer color printer of a type which performs printing at relatively high speed is conventionally known. This color printer has first to fourth printing units arranged on a paper feeding path extending in one direction. The printing units are sequentially operated to print four color component images of yellow, magenta, cyan and black on the same area of paper which is fed along the paper feeding path. The four color component images are combined to form a color image. Each printing unit includes a thermal print head, a platen, an ink ribbon, and a head lift mechanism. The thermal print head is a line head having a line of heat-generating resistors disposed perpendicular to the paper feeding direction, and driven while being maintained at a contact position at which the thermal print head pressing the paper against the platen. The head lift mechanism is operated to raise the print head to a standby position apart from the contact position when the paper is fed without driving the print head. The ink ribbon is supported in such a manner that it can be fed between the heat-generating resistors and the paper in a direction perpendicular to the line of heat-generating resistors. The ink ribbon is fed at a speed corresponding to the paper feeding speed in a state where the print head is set at the contact position. A color printer of the foregoing type has been disclosed in, for example, Jpn. Pat. Appln. KOKAI Publication No. 59-188452.

Jpn. Pat. Appln. KOKAI Publication No. 8-1967 filed by the present applicant discloses a thermal transfer color printer capable of preventing a continuous paper from being wasted when issuing labels printed on the paper and separated therefrom at an outlet portion of the paper feeding path. Although this color printer is similar to the above-mentioned color printer with regard to the basic structure, the front edge of the paper is returned to an initial position from which the paper starts to be fed towards the print head of the first printing unit, except the case where a plurality of same labels are successively issued. If the print heads of the first to fourth printing units are sequentially driven to print another label without returning the front edge of the paper, the label is unintentionally printed in an area located behind a blank having a length which exceeds the distance from the print head of the first printing unit to that of the fourth printing unit. In order to prevent the paper from being wasted due to the blank, the foregoing color printer feeds the front edge of the paper backward to the initial position and then forward to load the paper into the first to fourth printing units. All the print heads are set to the standby position immediately before the paper is moved backward, and set into the contact position again immediately before the paper is moved forward.

However, the above-mentioned color printer has the following problems.

When the paper is moved forward, the print head of each printing unit is set to be in contact with the platen under pressure corresponding to the weight thereof. In this case, an impact is generated at a moment when the front edge of the paper is introduced between the print head and the platen, thereby distorting the surface of the paper. As a result, the quality of an image printed on the surface of the paper deteriorates.

The print heads of the first to fourth printing units are operated after a label printing area of the paper has reached the printing position. However, since the ink ribbons begin to be fed from the time when the print heads are simultaneously set into the contact position, the ink ribbon is wasted in a quantity corresponding to the distance from the label printing area to the corresponding print head.

In the above-mentioned color printer, each head lift mechanism includes a solenoid formed of a coil, a plunger and the like and requiring electric power continuously supplied when the paper is moved backward. The plunger is energized by an current flowing in the coil upon supply of electric power and raise the print head to the standby position against the weight of the print head. Since the foregoing operation is frequently repeated, the coil of the solenoid and the electronic components forming a driving circuit of the solenoid suffer from relatively short service life. Further, since the ink ribbon is continuously brought into contact with the paper under the weight of the print head even if the color printer is not operated, the paper can sometimes be contaminated by the ink of the ink ribbon.

SUMMARY OF THE INVENTION

An object of the present invention is to provide a printer device capable of preventing deterioration in the quality of printed images.

The object can be achieved by a printer device including a plurality of platens arranged on a feeding path, for feeding a printing medium having a plurality of printing areas arranged in series, a plurality of print heads arranged on the feeding path to face the platens for performing a printing on the same printing area of the printing medium fed along the feeding path, a feeding roller section for supplying the printing medium along the feeding path to the print heads, a position sensing section disposed on the feeding path between a print head nearest the feeding roller and the feeding roller section for sensing that the printing medium has been set at a printing start position, a plurality of head-position setting sections each for setting a corresponding print head to a standby position apart from a corresponding platen before the printing medium has been fed to the printing start position and for setting the corresponding print head to a contact position at which the print head come in contact with the corresponding platen after the printing medium has been fed to the printing start position, and a timing control circuit for sequentially driving the head lift mechanisms such that each print head is set to the contact position when a front edge of the printing medium has reached a position slightly advanced over the print head.

According to the printer device, the plurality of print heads are sequentially moved from the standby position to the contact position to press a portion of the printing medium between the front edge and the printing area against the platens. Therefore, the front edge of the printing medium is not introduced into the printing position of each print head after the print head has set to the contact position. As a result, deterioration in the quality of the printed image can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A color printer according to a first embodiment of the present invention will now be described with reference to the drawings. The color printer is a thermal transfer color printer for issuing labels.

Figure 1:
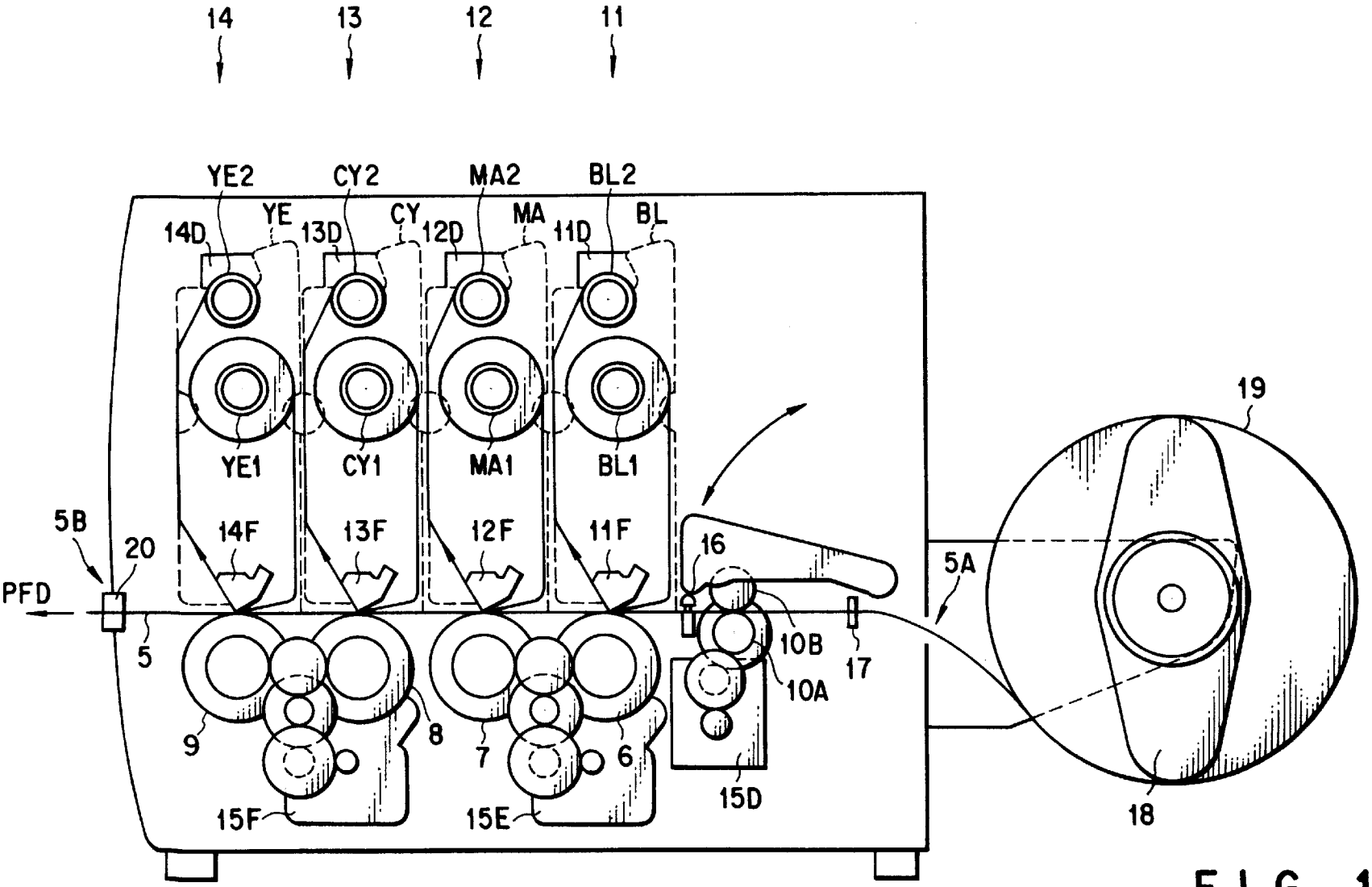
FIG. 1 is a diagram schematically showing the structure of a color printer according to a first embodiment of the present invention.
Figure 2:
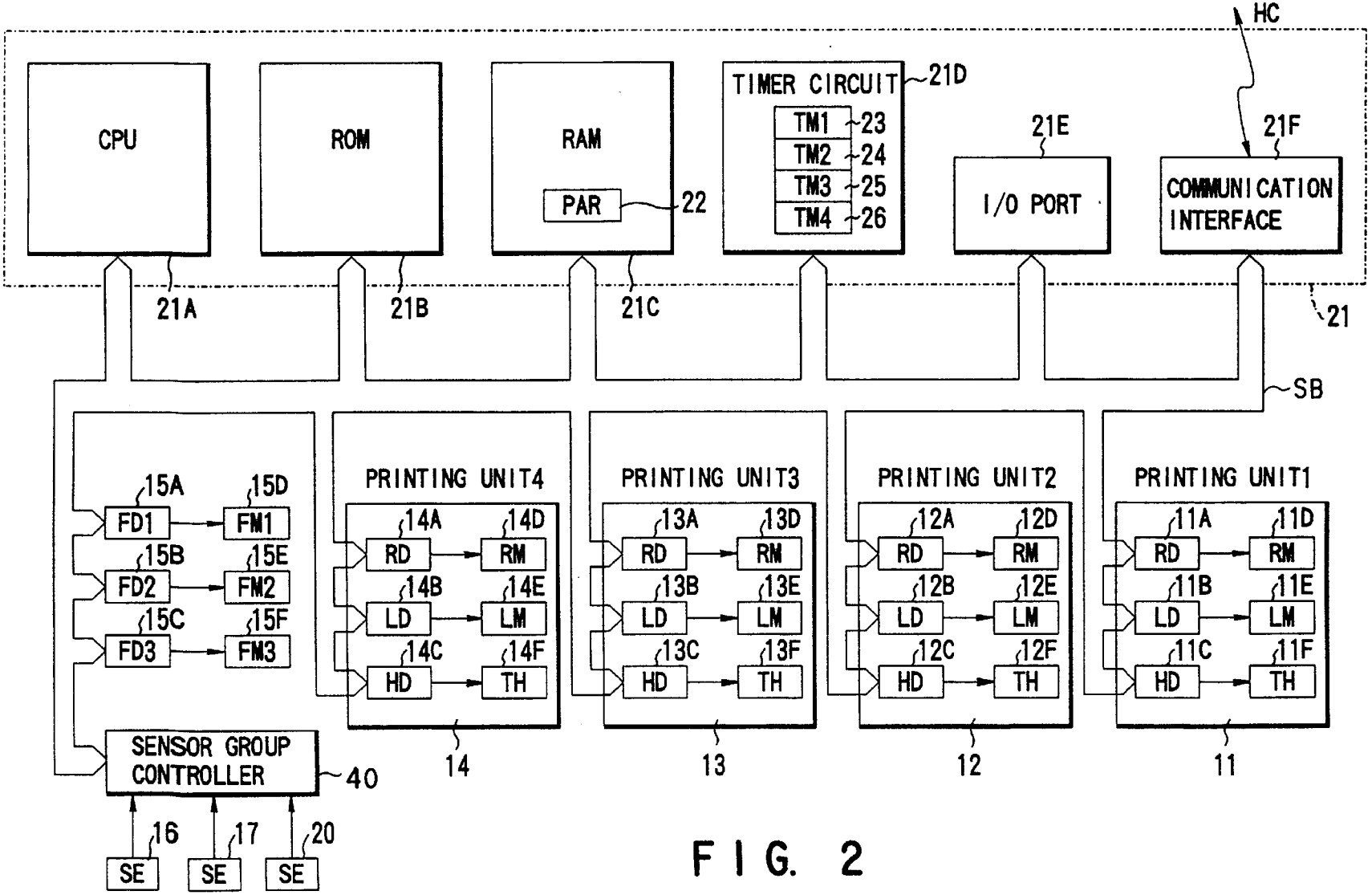
FIG. 2 is a block diagram schematically showing the circuit arrangement of the color printer shown in FIG. 1.

FIG. 1 schematically shows the structure of the color printer, and FIG. 2 shows a control circuit of the color printer. The color printer comprises a paper feeding path 5 extending in one direction, a paper supply port 5A serving as the inlet of the paper feeding path 5, a paper holder 18 located outside the paper supply port 5A and mounted to rotatablly support a roll of the continuous paper 19, a pair of feeding rollers 10A and 10B for holding the paper 19 supplied through the paper supply port 5A and feeding the paper 19 along the paper feeding path 5 at a constant speed, and printing units 11, 12, 13 and 14 arranged on the paper feeding path 5. The continuous paper 19 is a label paper constituted by a plurality of label seals adhered to the base paper tape and arranged in series at preset intervals as a printing medium. The printing units 11, 12, 13 and 14 are sequentially operated to print four color component images of black, magenta, cyan and yellow, on the same printing area corresponding to one label seal of the continuous paper 19 which is fed along the paper feeding path 5, the four color component images being combined to form a color label.

The printing units 11, 12, 13 and 14 comprise corresponding ribbon magazines BL, MA, CY and YE, ribbon motor drivers 11A, 12A, 13A and 14A, lift mechanism drivers 11B, 12B, 13B and 14B, head drivers 11C, 12C, 13C and 14C, ribbon motors 11D, 12D, 13D and 14D, head lift mechanisms 11E, 12E, 13E and 14E, thermal print heads 11F, 12F, 13F and 14F and platens 6, 7, 8 and 9. The ribbon magazines BL, MA, CY and YE have corresponding feeding rollers BL1, MA1, CY1 and YE1 and winding rollers BL1, MA1, CY1 and YE1. The ribbon magazines BL, MA, CY and YE are detachably mounted on the printing units 11, 12, 13 and 14. The feeding rollers BL1, MA1, CY1 and YE1 are rotated by the ribbon motors 11D, 12D, 13D and 14D, and respectively support rolls of black, magenta, cyan and yellow ink ribbons to feed the ink ribbons to be used for printing. The winding rollers BL1, MA1, CY1 and YE1 are also rotated by the ribbon motors 11D, 12D, 13D and 14D to wind the ink ribbons which have been used for printing. The ribbon motor drivers 11A, 12A, 13A and 14A drive the corresponding ribbon motors 11D, 12D, 13D and 14D. The lift mechanism drivers 11B, 12B, 13B and 14B drive the corresponding head lift mechanisms 11E, 12E, 13E and 14E. The head drivers 11C, 12C, 13C and 14C drive the corresponding thermal print heads 11F, 12F, 13F and 14F.

Each of the thermal print heads 11F, 12F, 13F and 14F is a line head having a line of heat-generating resistors and driven in a state where it presses the paper 19 to a corresponding one of the platens 6, 7, 8 and 9. The heat-generating resistors are formed on a flat end surface provided to a rectangular parallelepiped line head, arranged in one line with a width of 4 inches, and set perpendicular to paper feeding direction PFD. The head lift mechanisms 11E, 12E, 13E and 14E are provided for raising the thermal print heads 11F, 12F, 13F and 14F to standby position apart from the contact position in a case where the paper 19 is fed without driving the thermal print heads 11F, 12F, 13F and 14F. In a state where the ribbon magazines BL, MA, CY and YE are mounted on the printing units 11, 12, 13 and 14, the four color ink ribbons are supported between the heat-generating resistors of the thermal print heads 11F, 12F, 13F and 14F and the paper 19 in such a manner that the ink ribbons can be fed in a direction perpendicular to the line of the heat-generating resistors. When the thermal print heads 11F, 12F, 13F and 14F are set to the contact position, the ink ribbons are fed at the speed corresponding to the feeding speed of the paper 19.

The color printer further comprises a feeding motor 15D for rotating the feeding roller 10A, a feeding motor 15E for rotating the platens 6 and 7, a feeding motor 15A for rotating the platens 8 and 9, and a front-edge sensing section 16 disposed on the paper feeding path 5 between the feeding rollers 10A and 10B and the first printing unit 11. The color printer further comprises a paper empty sensing section 17 disposed on the paper feeding path 5 near the paper supply port 5A, and a paper sensing section 20 disposed at a label issue port 5B. The front-edge sensing section 16 includes a transmission-type optical sensor for sensing a gap between adjacent two label seals and a reflecting type optical sensor for sensing a mark printed on the back surface of the paper 19. The front edge of the paper 19 is detected from the gap or the mark. The paper empty sensing section 17 comprises a transmission-type optical sensor for sensing an absence of the paper 19. The paper sensing section 20 comprises a transmission-type optical sensor for sensing a remaining portion of the paper 19 after cutting of a label. The feeding motors 15D, 15E and 15F are rotated by corresponding feeding motor drivers 15A, 15B and 15C. The front-edge sensing section 16, the paper empty sensing section 17 and the paper sensing section 20 are driven by a sensor-group controller 40.

The color printer has an engine controller 21 for controlling the printing units 11, 12, 13 and 14, the feeding motors 15D, 15E and 15F and other components. The engine controller 21 includes a CPU 21A, A ROM 21B, a RAM 21C, a timer circuit 21D, an input and output port 21E and a communication interface 21F. The CPU 21A is connected via a system bus SB to the ROM 21A, the RAM 21C, the timer circuit 21D, the input and output port 21E, the communication interface 21F, the feeding motor drivers 15A, 15B and 15C, the sensor-group controller 40, the ribbon motor drivers 11A, 12A, 13A and 14A, the lift mechanism drivers 11B, 12B, 13B and 14B and the head drivers 11C, 12C, 13C and 14C. The CPU 21A performs a variety of data processing's required to control the above-mentioned components. The ROM 21B stores a control program for the CPU 21A and other fixed data items. The RAM 21C temporarily stores data input to and output from the CPU 21A. The RAM 21C includes a printing-area register 22 for storing printing-area information such as the maximum effective printing range of the printing area corresponding to the label seal. The timer circuit 21D includes first to fourth timers 23, 24, 25 and 26 for storing first to fourth feeding periods to successively generate first to fourth interruption signals upon elapse of the feeding periods. If interruptions by the first to fourth timers 23, 24, 25 and 26 are not inhibited, the CPU 21A processes the first to fourth interruption signals in rotation. The input and output port 21E is provided for establishing the connection of the various peripheral units. The communication interface 21F is provided for receiving a label-size setting command, a format command for instructing a printing format, and printing data, such as characters, numerals and bar codes supplied from an external host computer HC.

Figure 3A:
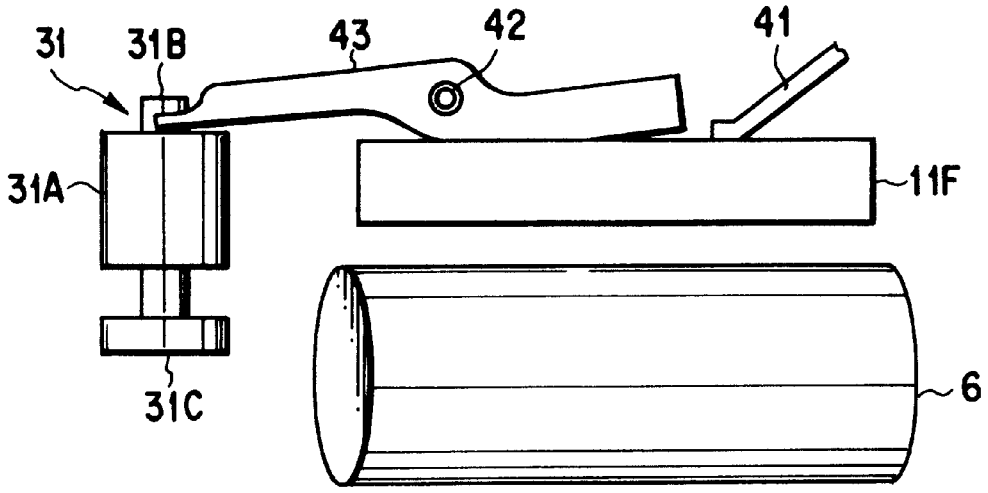
FIG. 3A is a diagram showing a state where the head lift mechanism of the first printing unit shown in FIG. 1 has set the print head to a standby position.
Figure 3B:
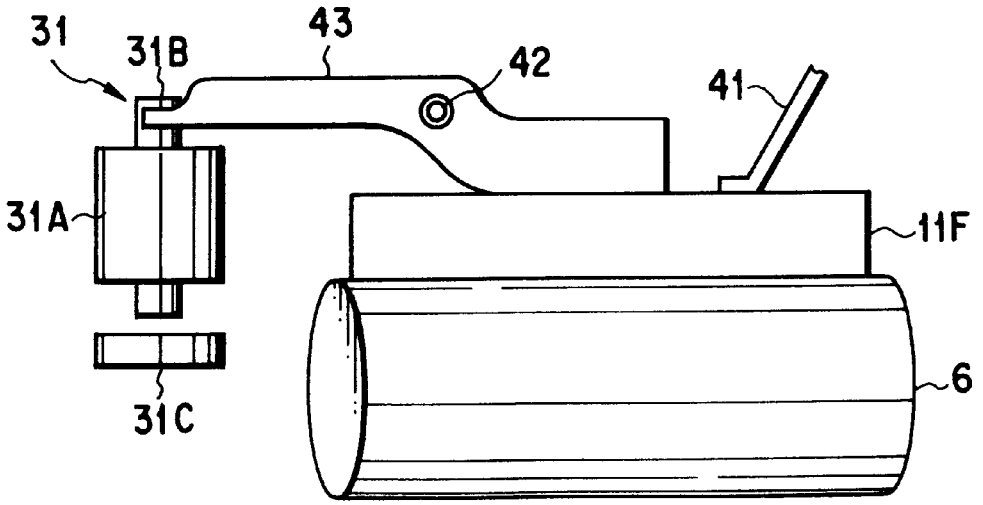
FIG. 3B is a diagram showing a state where the head lift mechanism of the first printing unit shown in FIG. 1 has set the print head to a contact position.

The head lift mechanisms 11E, 12E, 13E and 14E are structured in the following manner in order to set the thermal print head 11F at the standby position or the contact position. Since the head lift mechanisms 11E, 12E, 13E and 14E have similar structures, description will be performed about the head lift mechanism 11E and descriptions about the head lift mechanisms 12E, 13E and 14E are omitted. FIG. 3A shows a state where the head lift mechanism 11E has brought the thermal print head thermal print head 11F to the standby position, and FIG. 3B shows a state where the head lift mechanism 11E has brought the thermal print head 11F to the contact position. The head lift mechanism 11E has a self-retaining solenoid 31, a leaf spring 41 and a transmission plate 43. The self-retaining solenoid 31 comprises a body 31A containing a cylindrical coil, a plunger 31B vertically movable in a through hole of the body 31A which is located inside the cylindrical coil, and a permanent magnet 31C disposed to come in contact with an end of the plunger 31B when the plunger 31B has been pull down to the lowermost position. The leaf spring 41 uniformly urges the thermal print head 11F toward the platen 6 located below and facing the thermal print head 11F. One end of the transmission plate 43 is connected to the plunger 31B and the other end of the same is connected to the thermal print head 11F. The transmission plate 43 is rotatablly mounted to a rotational shaft 42.

The solenoid 31 is energized by a forward current pulse applied to set the thermal print head 11F to the standby position, and a reverse current pulse applied to set the thermal print head 11F to the contact position.

When the forward current pulse is applied to the cylindrical coil of the body 31A, the plunger 31B is introduced downward against the urging force of the leaf spring 41. At this time, the plunger 31B causes the transmission plate 43 to rotate around the rotational shaft 42, thereby moving the other end of the transmission plate 43 upward along with the thermal print head 11F. As a result, the thermal print head 11F is brought to the standby position apart from the platen 6 for about 1 mm. When the thermal print head 11F has been set to the standby position, one end of the plunger 31B is brought to the lowermost introduction position at which it comes in contact with the permanent magnet 31C. The permanent magnet 31C attracts the end of the plunger 31B by the magnetic force thereof. Since the attracting force is determined to be greater than the urging force of the leaf spring 41, the end of the plunger 31B is maintained at the lowest pull-down position even if the coil current is interrupted. As a result, the thermal print head 11F is maintained at the standby position.

When the reverse-directional pulse is applied to the cylindrical coil of the body 31A, the plunger 31B is pushed outwards against the attracting force of the permanent magnet 31C. At this time, also the urging force of the leaf spring 41 effectively acts. The plunger 31B rotates the transmission plate 43 around the rotational shaft 42 so that the other end of the transmission plate 43 is moved downwards together with the thermal print head 11F. As a result, the thermal print head 11F is brought to the contact position at which it comes in contact with the platen 6. Then, the thermal print head 11F is maintained at the contact position by the urging force of the leaf spring 41.

Figure 4:
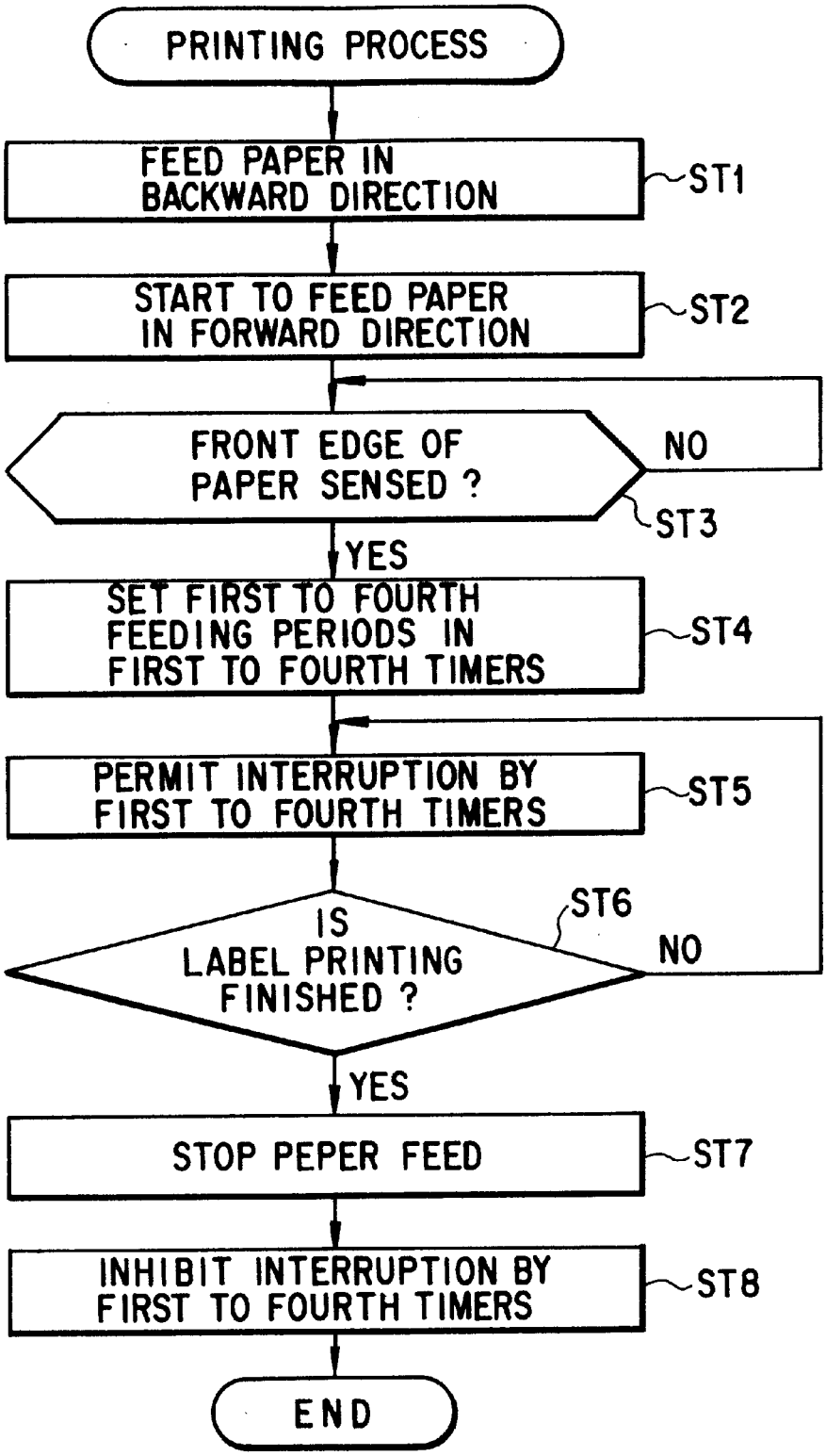
FIG. 4 is a flowchart showing a printing process of an engine controller shown in FIG. 1.

The operation of the color printer having the above-mentioned structure will now be described with reference to FIG. 4.

In this color printer, the paper 19 is previously drawn from the paper holder 18, followed by being inserted into the feeding rollers 10A and 10B through the paper supply port 5. Note that the thermal print heads 11F, 12F, 13F and 14F are maintained at the standby position by the head lift mechanisms 11E, 12E, 13E and 14E owning to the permanent magnet 31C of the self-retaining solenoid 31. The engine controller 21 controls the feeding motors 15D, 15E and 15F to feed the paper 19 forward. The feeding motors 15D, 15E and 15F stop when the paper sensing section 20 has sensed the paper 19. Then, the engine controller 21 performs the printing process shown in FIG. 4, based on control commands supplied from the external host computer HC. When the printing process begins, the paper 19 is fed backward in step ST1 by a predetermined distance which is longer than the distance from the paper sensing section 20 and the front-edge sensing section 16. As a result, the front edge of the paper 19 is brought to a position between the front-edge sensing section 16 and the feeding roller 10A. In step ST2, the feeding motors 15D, 15E and 15F rotate to feed the paper 19 forward at a speed suitable for printing. In step ST3, it is repeatedly checked whether the front-edge sensing section 16 has sensed the front edge of the paper 19 in order to detect the position of the paper 19 fed along the paper feeding path 5. When the front edge of the paper 19 has been sensed by the front-edge sensing section 16, the first to fourth feeding periods are set to the first to fourth timers 23, 24, 25 and 26. Moreover, the operations of the first to fourth timers 23, 24, 25 and 26 are simultaneously started. The first to fourth feeding periods are time periods obtained by subtracting a preset period TA from a period required from a moment at which the front edge of the paper 19 has been sensed by the front-edge sensing section 16 to a moment at which the first printing area reaches the printing positions of the thermal print heads 11F, 12F, 13F and 14F. The first to fourth feeding periods are determined in accordance with the printing-area information stored in the printing-area register 22, with taking the feeding speed of the paper 19 and the delay of the control into consideration. However, the preset period TA is made to be shorter than the period required for feeding the paper 19 by the distance from the front edge to the first printing area of the paper 19. After the operations of the first to fourth timers 23, 24, 25 and 26 have been started, steps ST5 and ST6 are repeatedly executed. In step ST5, interruptions from the first to fourth timers 23, 24, 25 and 26 are permitted. In step ST6, it is checked whether printing of one label has been finished. Since the first to fourth feeding periods respectively depend upon the distances between the thermal print heads 11F, 12F, 13F and 14F to the front-edge sensing section 16, the first to fourth timers 23, 24, 25 and 26 generate first to fourth interruption signals in the above-mentioned sequential order. After detecting in step ST6 that the printing of one label is finished, feeding of the paper 19 is stopped in step ST7, interruptions by the first to fourth timers 23, 24, 25 and 26 are inhibited in step ST8. The printing process is terminated after execution of step ST8 has.

FIGS. 5A to 5D respectively show first to fourth printing unit control processes which are performed in response to the first to fourth interruption signals.

Figure 5B:
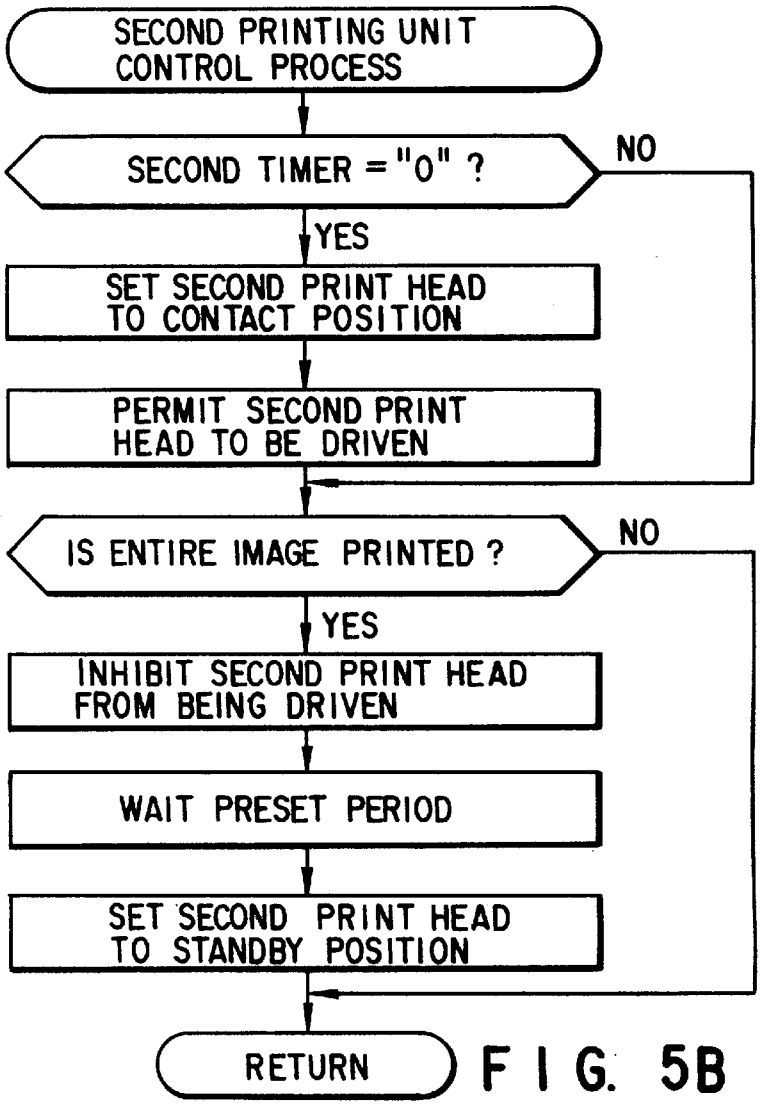
FIGS. 5A to 5D are flowcharts showing first to fourth printing unit control process which are performed upon interruptions by first to fourth timers shown in FIG. 2.
Figure 5A:
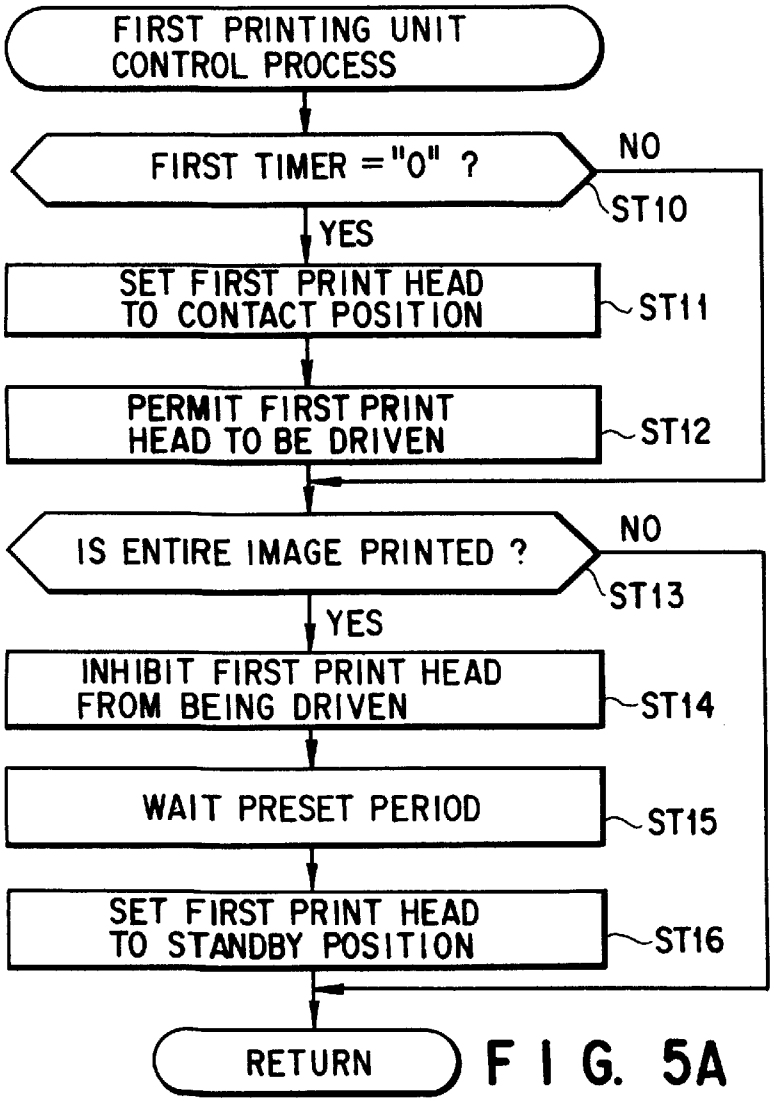

As shown in FIG. 5A, when the first printing unit control process begins, it is confirmed in step ST10 that the first timer 23 has been made to be "0" upon elapse of the first feeding period. Thus, the first print head 11F is brought to the contact position by the head lift mechanism 11E in step ST11, and the first print head 11F is permitted to be driven in step ST12. Specifically, a printing interruption process starts to drive the first print head 11F at a predetermined printing timing. In this printing interruption process, the first print head 11F is driven in accordance with printing data for each line to be printed on the paper 19. After the printing interruption process has been started, it is checked in step ST13 whether the entire image has been printed by the first print head 11F. Step ST13 is also executed when the first timer 23 is not "0" in step ST10. If the entire image has not been printed, the first printing unit control process is interrupted, and then step ST5 of the printing process is executed again. After confirming that the entire image has been printed, driving of the first print head 11F is inhibited by completing the printing interruption process in step ST14. The first print head 11F is caused to wait for a preset standby preparation period in step ST15, and then brought to the standby position by the head lift mechanism 11E in step ST16. At this time, feeding of the ink ribbon is stopped. Then, the first printing unit control process is terminated, and step ST5 of the printing process is executed again.

Figure 5D:
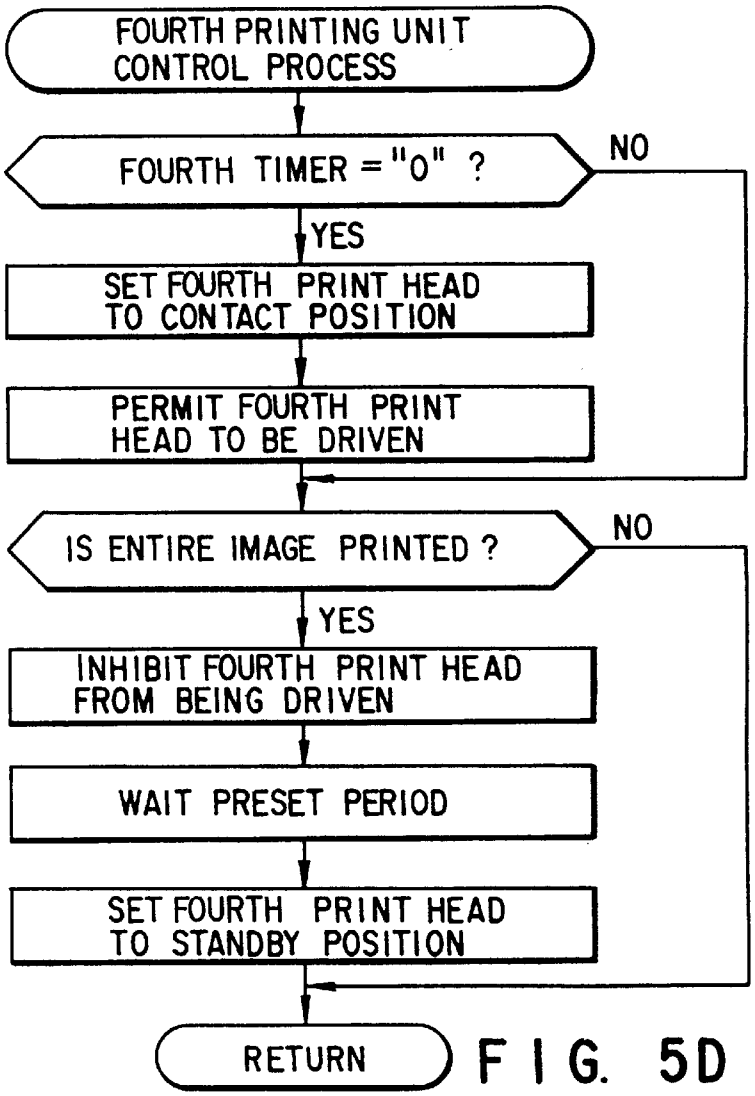
Figure 5C:
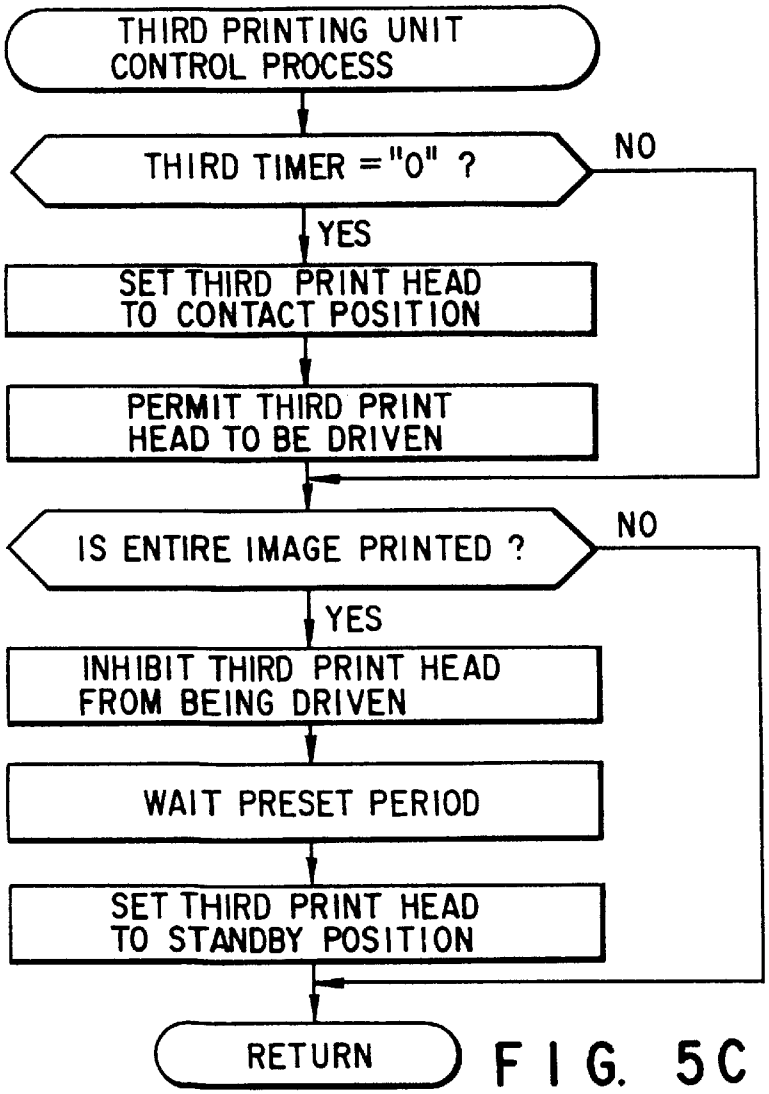

Since the second to fourth printing unit control processes control the second to fourth printing units 12 to 14 in the same manner as the first printing unit 11 as shown in FIGS. 5B to 5D, descriptions of the second to fourth printing unit control processes are omitted.

Figure 6:
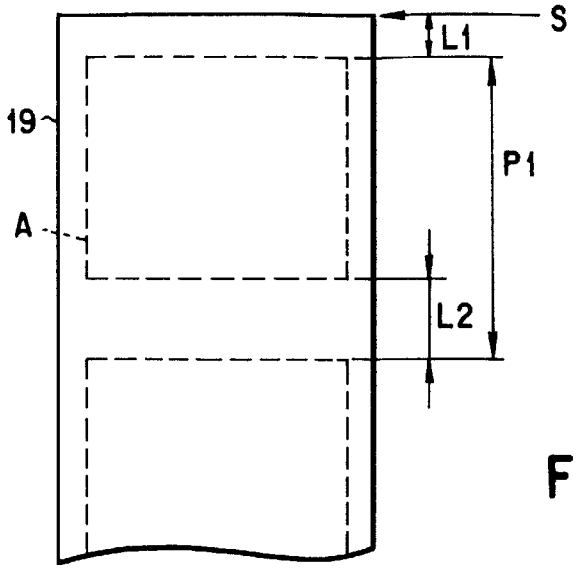
FIG. 6 is a diagram for explaining a printing area of the continuous paper shown in FIG. 1.
Figure 7:
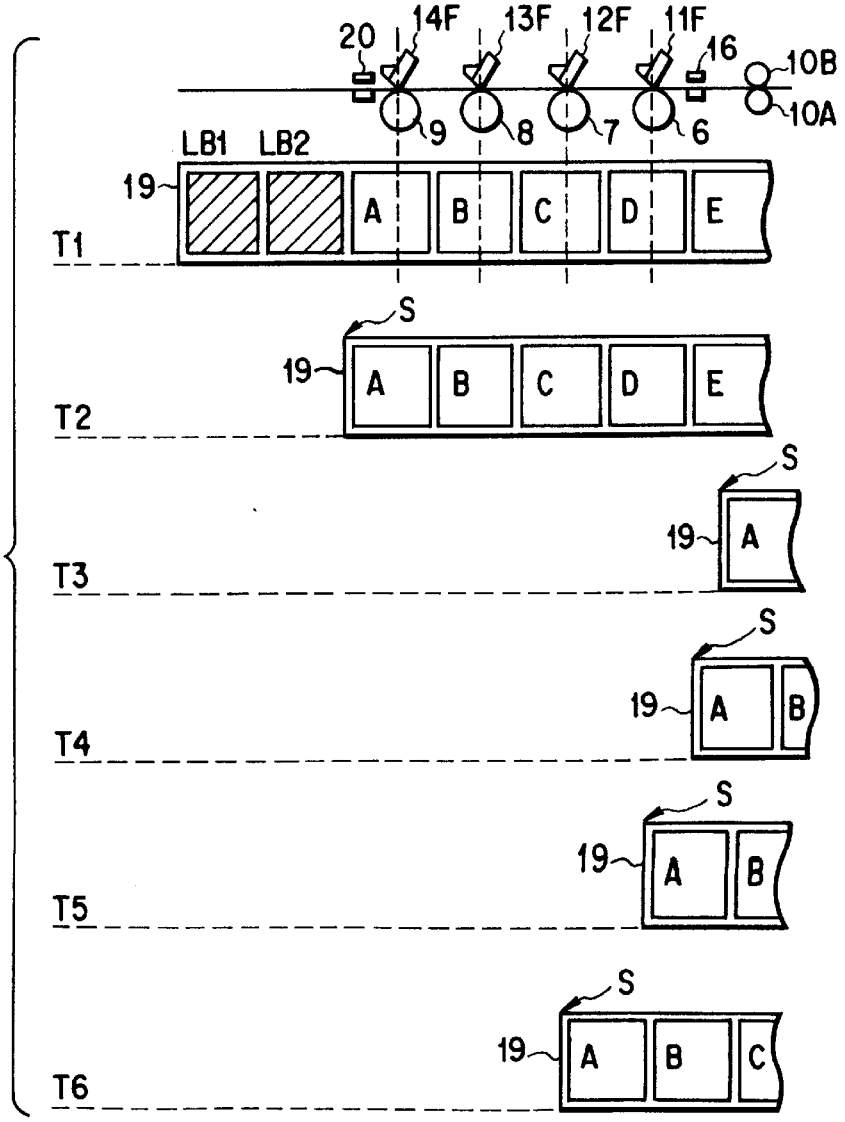
FIG. 7 is a diagram showing the time sequential change in the positional relationship between the printing area and the print heads of the first to fourth printing units shown in FIG. 1.

In the color printer explained above, the printing area register 22 stores printing-area information including the maximum effective printing range of the printing area which is determined by the effective printing width and the effective printing length, and the distance L1 from front edge S of the paper 19 to the first printing area A and distance L2 between adjacent two printing areas or pitch P1 of the same as shown in FIG. 6. The printing-area information is used to feed the paper as shown in FIG. 7.

Assume that labels LB1 and LB2 are issued by the color printer and separated or cut at time T1. When the printing process for another label begins, the remaining paper 19 is fed backward from time T2. When the front edge S of the paper 19 has reached a position between the front-edge sensing section 16 and the feeding roller 10A, the paper 19 is fed forward. When the front edge S of the paper 19 has been sensed by the front-edge sensing section 16 at time T4, the timers 23 to 26 are started.

The head lift mechanism 11E sets the print head 11F to the contact position at time T5 as a result of interruption by the timer 23. As a result, the print head 11 presses, against the platen 6, a portion of the paper 19 between the front edge S of the paper 19 and the first printing area A. Since the front edge S of the paper 19 has passed through the printing position of the print head 11F at this time, the paper 19 would not be introduced between the print head 11F and the platen 6 in a condition where the print head 11F is pressed against the platen 6. The print head 11F is driven from the time when the first printing area A of the paper 19 has reached the printing position.

The head lift mechanism 12E sets the print head 12F to the contact position at time T6 owning to the interruption by the timer 24. As a result, the print head 12F presses, against the platen 7, the portion of the paper 19 between the front edge S of the paper 19 and the first printing area A. Since the front edge S of the paper 19 has passed through the printing position of the print head 12F at this time, the paper 19 would not be introduced between the print head 12F and the platen 7 in a condition where the print head 12F is pressed against the platen 7. The print head 12F is driven from the time when the front printing area A of the paper 19 has reached the printing position.

The head lift mechanism 13E sets the print head 13F to the contact position owning to the interruption by the timer 25. As a result, the print head 13F presses, against the platen 8, the portion of the paper 19 between the front edge S of the paper 19 and the first printing area A. Since the front edge S of the paper 19 has passed through the printing position of the print head 13F at this time, the paper 19 would not be introduced between the print head 13F and the platen 8 in a condition where the print head 13F is pressed against the platen 8. The print head 13F is driven from the time when the first printing area A of the paper 19 has reached the printing position.

The head lift mechanism 14E sets the print head 14F to the contact position owning to the interruption by the timer 26. As a result, the print head 14F presses, against the platen 9, the portion of the paper 19 between the front edge S of the paper 19 and the first printing area A. Since the front edge S of the paper 19 has passed through the printing position of the print head 14F at this time, the paper 19 would not be introduced between the print head 134F and the platen 9 in a condition where the print head 134 is pressed against the platen 9. The print head 14F is driven from the time when the first printing area A of the paper 19 has reached the printing position.

As described above, the label is printed on the printing area A sequentially by the print heads 11F, 12F, 13F and 14F. The paper 19 is fed until the rear end of the printing area A of the label reaches the label issue port 5B except for a case where a plurality of labels are successively issued. Then, the driving of the thermal print heads 11F, 12F, 13F and 14F are interrupted. When the printing area A of the label has been removed from the paper 19 at the rear end thereof, the paper 19 left after the cutting is sensed by the paper sensing section 20. The paper feed and driving of the thermal print heads 11F, 12F, 13F and 14F are restarted when the remaining paper 19 has been sensed. Similarly, labels are printed on the printing areas A, B, C, D and so forth. The head lift mechanism 11E waits for elapse of a preset standby preparation period after the label image has been printed, and then sets the print head 11F to the standby position. The head lift mechanisms 11E, 12E, 13E and 14E also wait for elapse of a preset standby period, and then set the print heads 12F, 13F and 14F to the standby position.

The printing process is terminated after all of the thermal print heads 11F, 12F, 13F and 14F have been set to the standby position.

According to the above-mentioned first embodiment, the thermal print heads 11F, 12F, 13F and 14F are sequentially moved from the standby position to the contact position to press, against the platens 6, 7, 8 and 9, the portion of the paper between the front edge of the paper 19 and the printing area A after the printing process begins. Therefore, the front edge of the paper 19 would not be introduced to the printing position in a condition where the print heads 11F to 14F have been set at the contact position. Therefore, deterioration in the quality of the printed image can be prevented.

Since each of the thermal print heads 11F, 12F, 13F and 14F is moved to the standby position after the label image has been printed, wasteful consumption of the ink ribbon can be prevented. Moreover, influence of the other print heads which are being driven can be eliminated satisfactorily. In addition, the thermal print heads 11F, 12F, 13F and 14F are always maintained at the standby position before electric power is supplied and also before start of the printing process. As a result, the ink ribbons do not come in contact with the paper 19 under pressure for a long time. Therefore, contamination of the paper 19 by ink of the ink ribbons can be prevented.

Moreover, the head lift mechanisms 11E, 12E, 13E and 14E temporarily allow a current to flow in the coil of the self-retaining solenoid 31 so as to set the thermal print heads 11F, 12F, 13F and 14F to the standby position or the contact position. Thus, electric power consumption of the self-retaining solenoid 31 can be prevented and the loads, which must be borne by the lift mechanism drivers 11B, 12B, 13B and 14B, can be reduced.

A color printer according to a second embodiment of the present invention will now be described with reference to the drawings.

Figure 8:
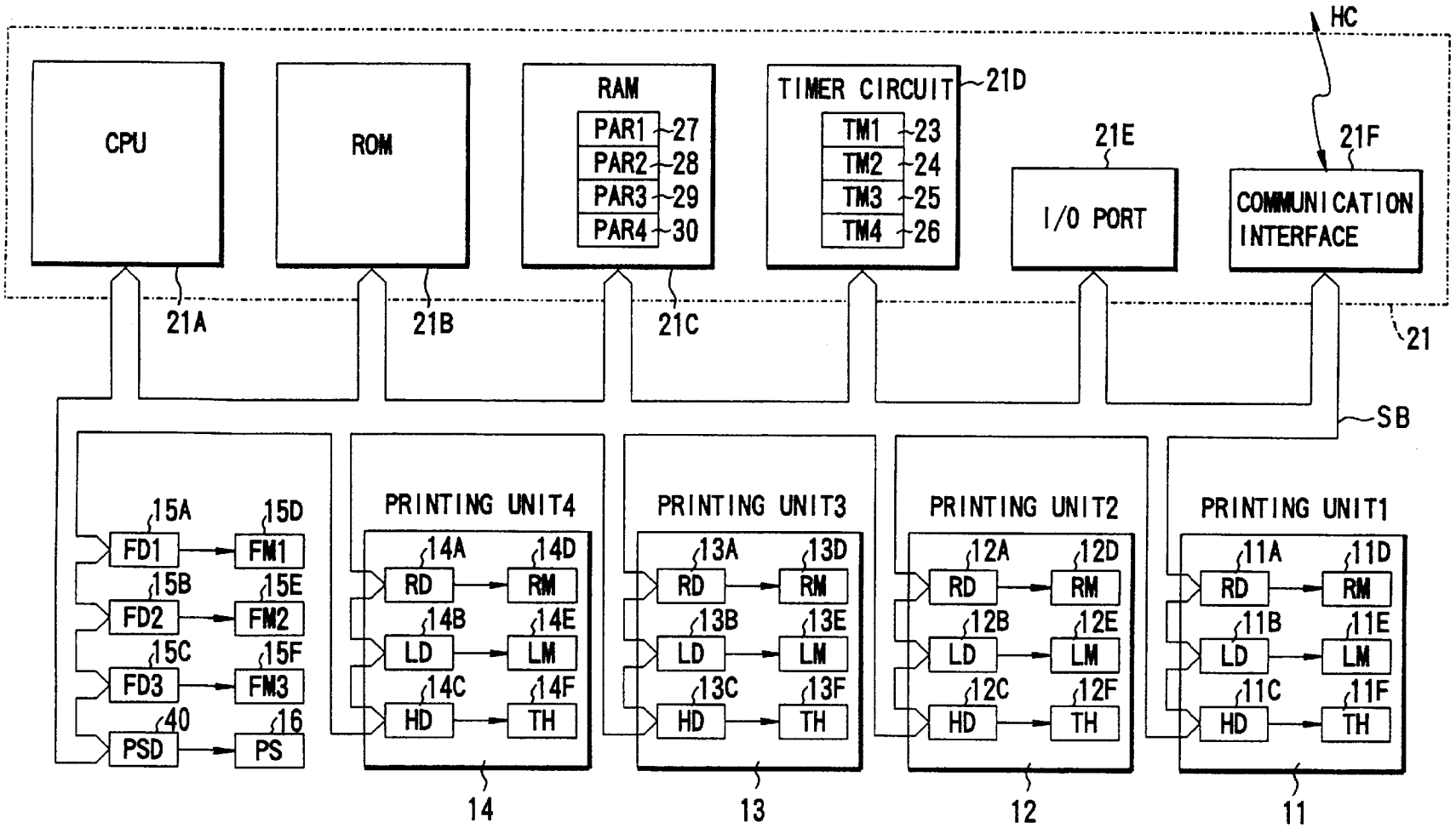
FIG. 8 is a block diagram schematically showing the circuit arrangement of a color printer according to a second embodiment of the present invention.

FIG. 8 schematically shows the structure of a circuit of the color printer. The color printer is used when the printing area of a label is composed of first to fourth specific color component areas assigned to black, magenta, cyan and yellow images. The RAM 21C has four printing area registers 27, 28, 29 and 30 provided to correspond to the specific color component areas. The color printer according to this embodiment is structured similarly to the color printer according to the first embodiment except the portions relating to the printing area registers 27, 28, 29 and 30. Therefore, similar elements are, in FIG. 8, given the same reference numerals and the similar elements are omitted from illustration.

Figure 11:
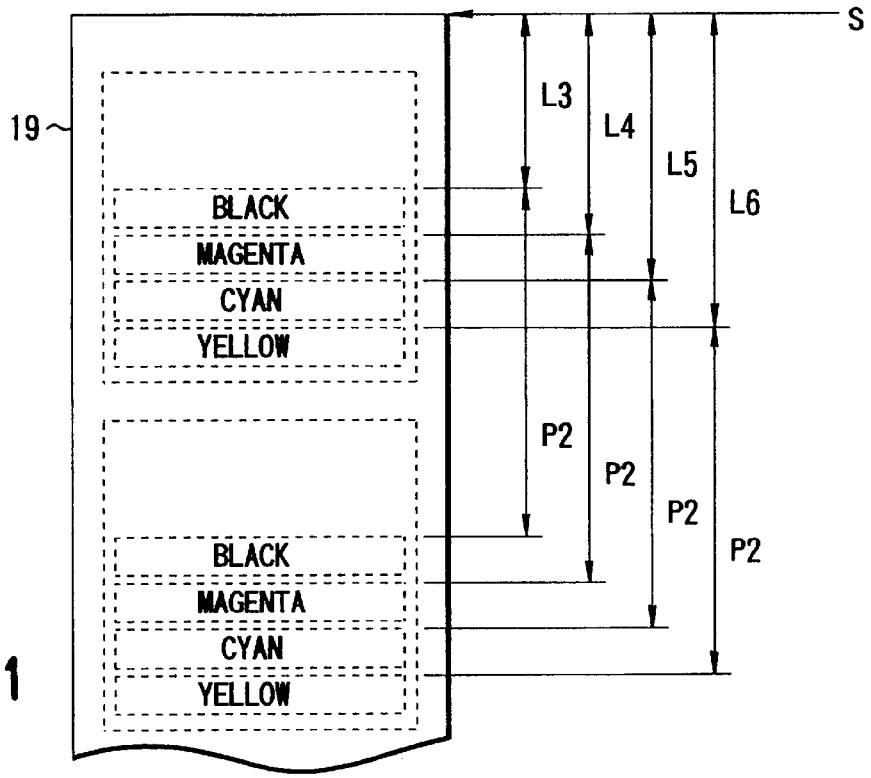
FIG. 11 is a diagram for explaining printing-area information stored in each printing-area register shown in FIG. 8.

The printing area registers 27, 28, 29 and 30 store printing-area information including the maximum effective printing range of the printing area determined by the effective printing width and the effective printing length; distances L3 to L6 from the front edge S of the paper 19 to the first to fourth specific color component areas of the first printing area; and pitch P2 of the same specific color component areas of the adjacent printing areas shown in FIG. 11.

The operation of the color printer according to this embodiment will now be described with reference to FIG. 9.

In this color printer, the paper 19 is previously drawn from the paper holder 18, followed by being inserted into the supply rollers 10A and 10B through the paper supply port 5. Note that the thermal print heads 11F, 12F, 13F and 14F respectively are maintained at the standby position by the head lift mechanisms 11E, 12E, 13E and 14E owning to the permanent magnet 31C of the self-retaining solenoid 31. The engine controller 21 controls the feeding motors 15D, 15E and 15F to feed the paper 19 forward. The feeding motors 15D, 15E and 15F stop when the paper sensing section 20 has sensed the paper 19. Then, the engine controller 21 performs the printing process shown in FIG. 9, based on control commands supplied from the external host computer HC. After the printing process begins, the paper 19 is, in step ST20, fed backward by a predetermined distance which is longer than the distance from the paper sensing section 20 and the front-edge sensing section 16. As a result, the front edge of the paper 19 is brought to a position between the front-edge sensing section 16 and the feeding roller 10A. In step ST21, the feeding motors 15D, 15E and 15F are driven to feed the paper 19 forward at a speed suitable for printing. In step ST22, it is repeatedly checked whether the front-edge sensing section 16 has sensed the front edge of the paper 19 in order to detect the position of the paper 19 which is fed on the paper feeding path 5. When the front edge of the paper 19 has been sensed by the front-edge sensing section 16, the first to fourth feeding periods are, in steps ST23 to ST26, set to the first to fourth timers 23, 24, 25 and 26. Moreover, the operations of the first to fourth timers 23, 24, 25 and 26 are started. The first to fourth time feeding periods are time periods obtained by subtracting a preset period TA from a period required from a moment at which the front edge of the paper 19 has been sensed by the front-edge sensing section 16 to a moment at which the first to fourth specific color component areas reach the printing positions for the thermal print heads 11F, 12F, 13F and 14F. The first to fourth feeding periods are determined in accordance with printing-area information stored in the printing area registers 27, 28, 29 and 30 with taking the feeding speed of the paper 19 and the delay of the control into consideration. However, the preset period TA is made to be shorter than the period required for feeding the paper 19 by the distance from the front edge of the paper 19 to the first specific color component area of the first printing area. After the operations of the first to fourth timers 23, 24, 25 and 26 have been started, steps ST27 and ST28 are repeatedly executed. In step ST27, interruptions by the timers 23, 24, 25 and 26 are permitted. In step ST28, it is checked whether printing of one label has been finished. Since the first to fourth feeding periods respectively depend upon the distances between the thermal print heads 11F, 12F, 13F and 14F to the front-edge sensing section 16, the first to fourth timers 23, 24, 25 and 26 generate first to fourth interruption signals in the above-mentioned sequential order. After detecting in step ST28 that printing of one label has been finished, feeding of the paper 19 is stopped in step ST29, and interruptions by the timers 23, 24, 25 and 26 are inhibited in step ST30. The printing process is terminated after execution of step ST30.

Figure 10:
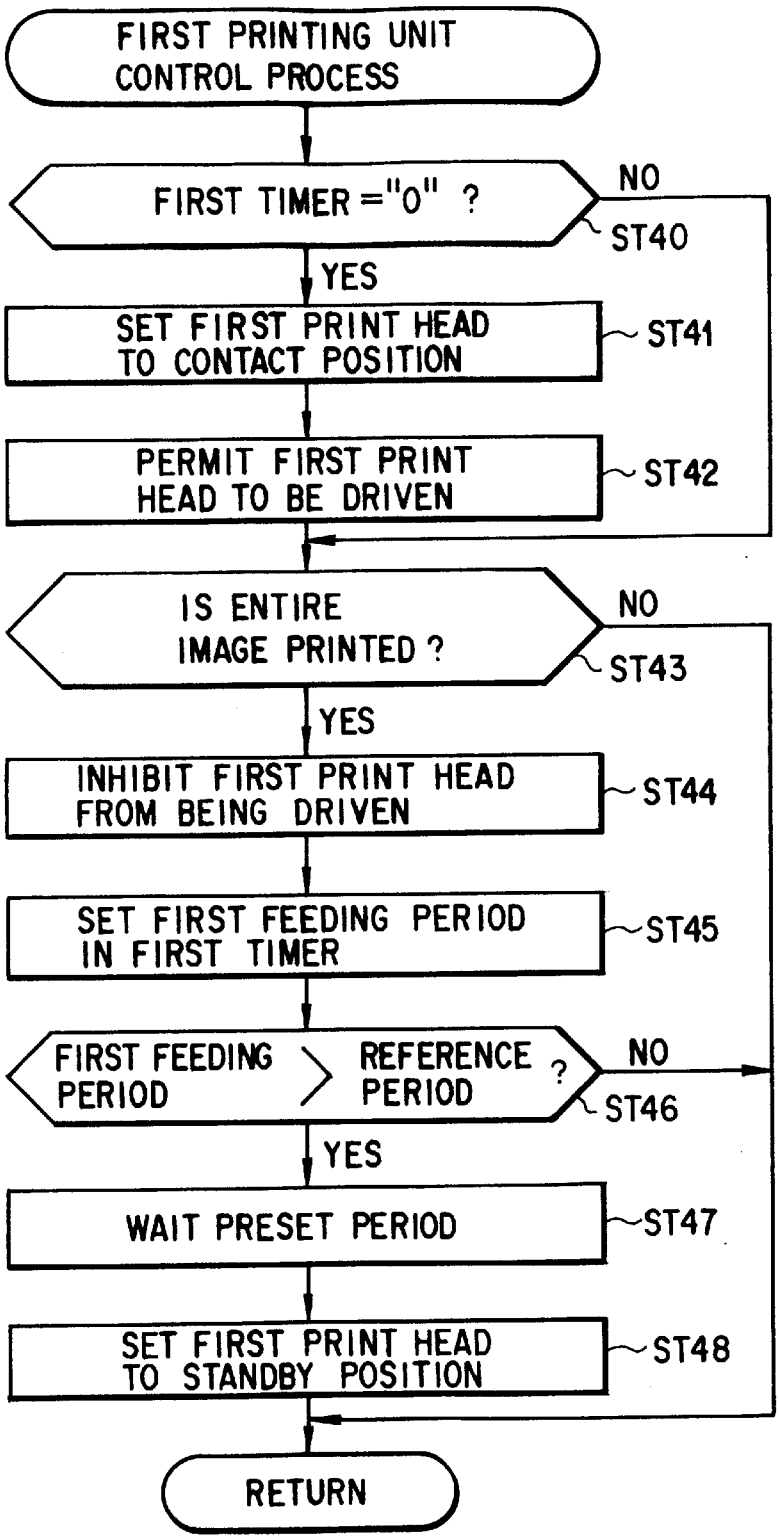
FIG. 10 is a flowchart of a first printing unit control process performed upon an interruption by the first timer shown in FIG. 8.

The engine controller 21 controls the first to fourth printing units in response to the first to fourth interruption signals. FIG. 10 shows a first printing unit control process.

As shown in FIG. 10, when the first printing unit control process begins, it is confirmed in step ST40 that the first timer 23 has been made to be "0" upon elapse of the first feeding period. Thus, the first print head 11F is brought to the contact position by the head lift mechanism 11E in step ST41, and driving of the first print head is permitted in step ST42. Specifically, a printing interruption process starts to drive the first print head 11F at a predetermined printing timing. In this printing interruption process, the first print head 11F is driven in accordance with printing data for each line to be printed on the paper 19. After the printing interruption process has been started, it is checked in step ST43 whether the entire image has been printed by the first print head 11F. Step ST43 is also executed when the first timer 23 is not "0" in step ST40. If the entire image has not been printed, the first printing unit control process is interrupted, and then step ST27 of the printing process is executed again. After detecting that the entire image has been printed, driving of the first print head 11F is inhibited by completing the printing interruption process in step ST44. In step ST45, the standby period is determined in accordance with printing-area information stored in the printing area register 27 and set to the first timer 23 as the first feeding period. The foregoing standby period is time obtained by subtracting a preset period TA from a period required for the paper 19 to be fed for the distance which is the same as pitch P2 of the same specific color component areas of the adjacent printing areas. The first timer 23 is started when the first feeding period has been set. In step ST46, it is checked whether the above-mentioned standby period is longer than a reference period obtained by adding the preset standby preparation period to the period previously confirmed to attain an effect of saving the ink ribbon. If the standby period is longer than the reference period, the first print head 11F is caused to wait for elapse of a preset standby preparation period in step ST47, and then the first print head 11F is brought to the standby position by the head lift mechanism 11E in step ST48. At this time, feeding of the ink ribbon is stopped. Then, the first printing unit control process is terminated, and step ST27 of the printing process is executed again.

Since the second to fourth printing unit control processes control the second to fourth printing units 12, 13 and 14 in the same manner as the first printing unit 11, descriptions of the second to fourth printing unit control processes are omitted.

Figure 12:
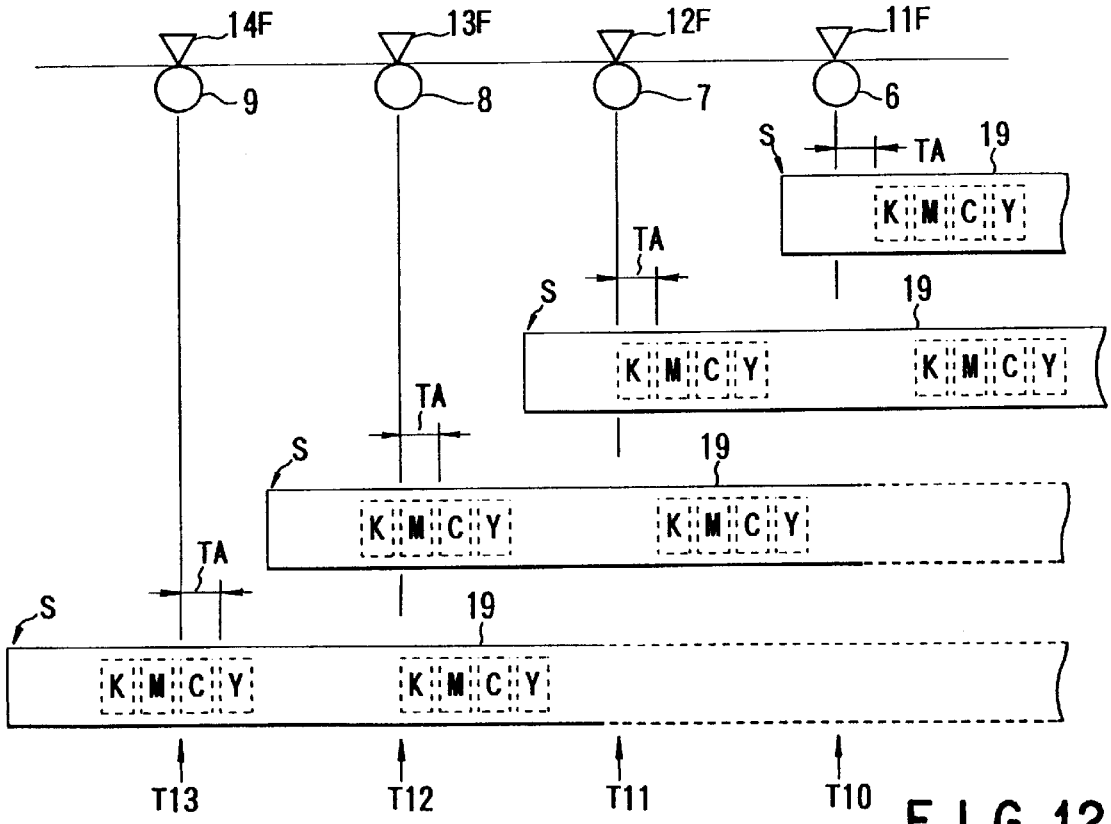
FIG. 12 is a diagram showing the time sequential change in the positional relationship between the printing area and the print head of the first to fourth printing units shown in FIG. 9.

In the color printer according to this embodiment, the printing area registers 27, 28, 29 and 30 store printing-area information including the maximum effective printing range in the printing area determined by the effective printing width and the effective printing length; and distances L3 to L6 from the front edge S of the paper 19 to the first to fourth specific color component areas of the first printing area; and the pitch P2 of the same specific color component areas of the adjacent printing areas, as shown in FIG. 11. The printing-area information is used to feed the paper 19 as shown in FIG. 12.

When the printing process begins, the paper 19 is fed backward. When the front edge S of the paper 19 has reached a position between the front-edge sensing section 16 and the feeding roller 10A, the paper 19 is fed forward. When the front edge S of the paper 19 has been sensed by the front-edge sensing section 16, the timers 23 to 26 are started.

The head lift mechanism 11E sets the print head 11F to the contact position at time T10 as a result of interruption by the timer 23. As a result, the print head 11F presses, against the platen 6, a portion of the paper 19 between the front edge S of the paper 19 and the first specific color component area of the first printing area. Since the front edge S of the paper 19 has passed through the printing position of the print head 11F at this time, the paper 19 would not be introduced between the print head 11F and the platen 6 in a condition where the print head 11F is pressed against the platen 6. The print head 11F is driven from the time when the first specific color component area of the first printing area of the paper 19 has reached the printing position.

The head lift mechanism 12E sets the print head 12F to the contact position at time T11 as a result of interruption by the timer 24. As a result, the print head 12F presses, against the platen 7, a portion of the paper 19 between the front edge S of the paper 19 and the second specific color component area of the first printing area. Since the front edge S of the paper 19 has passed through the printing position of the print head 12F at this time, the paper 19 would not be introduced between the print head 12F and the platen 7 in a condition where the print head 12F is pressed against the platen 7. The print head 12F is driven from the time when the second specific color component area of the first printing area of the paper 19 has reached the printing position.

The head lift mechanism 13E sets the print head 13F to the contact position at time T12 as a result of interruption by the timer 25. As a result, the print head 13F presses, against the platen 8, a portion of the paper 19 between the front edge S of the paper 19 and the third specific color component area of the first printing area. Since the front edge S of the paper 19 has passed through the printing position of the print head 13F at this time, the paper 19 would not be introduced between the print head 13F and the platen 8 in a condition where the print head 13F is pressed against the platen 8. The print head 13F is driven from the time when the third specific color component area of the first printing area of the paper 19 has reached the printing position.

The head lift mechanism 14E sets the print head 14F to the contact position at time T13 as a result of interruption by the timer 26. As a result, the print head 14F presses, against the platen 9, a portion of the paper 19 between the front edge S of the paper 19 and the fourth specific color component area of the first printing area. Since the front edge S of the paper 19 has passed through the printing position of the print head 14F at this time, the paper 19 would not be introduced between the print head 14F and the platen 9 in a condition where the print head 14F is pressed against the platen 9. The print head 14F is driven from the time when the fourth specific color component area of the first printing area of the paper 19 has reached the printing position.

As described above, the label is printed on the first to fourth specific color component areas of the printing area sequentially by the print heads 11F, 12F, 13F and 14F. The paper 19 is fed until the rear end of the printing area of the label reaches the label issue port 5B except for a case where a plurality of labels are successively issued. Then, driving of the thermal print heads 11F, 12F, 13F and 14F is interrupted.

When the printing area A of the label has been removed from the paper 19 at the rear end thereof, the paper 19 left after cutting is sensed by the paper sensing section 20. The paper feed and driving of the thermal print heads 11F, 12F, 13F and 14F are restarted when the remaining paper 19 has been sensed. Similarly, labels are printed on the subsequent printing areas. After the label image has been printed, the first timer 23 stores a standby period obtained by subtracting a preset period TA from a period required for feeding the paper 19 by the distance P2 from the first specific color component area to the first specific color component area of the next printing area, as the first feeding period. Then, the timer 23 is restarted. If the first feeding period is longer than the reference period, the head lift mechanism 11E sets the print head 11F to the standby position after elapse of the preset standby preparation period. The head lift mechanism 11E returns the print head 11F from the standby position to the contact position owning to the interruption by the first timer 23. The other timers 24, 25 and 26 are operated similarly to the timer 23, while the head lift mechanisms 12E, 13E and 14E are operated similarly to the head lift mechanism 11E.

According to the above-mentioned second embodiment, the same effects as those of the first embodiment can be obtained. The printing area registers 27, 28, 29 and 30 store printing-area informations of the first to fourth specific color component areas of each printing area, while the first to fourth timers 23, 24, 25 and 26 detect lapses of first to fourth feeding periods determined in accordance with the printing-area information. As a result, the thermal print heads 11F, 12F, 13F and 14F can appropriately be set to the contact position with respect to the first to fourth specific color component areas. Thus, distortion of the paper 19 causing the quality of the printed image to deteriorate can be prevented. Moreover, wasteful consumption of the ink ribbons can be prevented. Since the thermal print heads 11F, 12F, 13F and 14F can appropriately be set to the standby position when the paper is fed to the next specific color component area, the ink ribbons can be save more satisfactorily.

Since the printing areas information of the specific color component areas are stored in the printing area registers 27, 28, 29 and 30, bit map image data produced from the printing data can be compressed to the size corresponding to the specific color component area. As a result, the time required to produce image data and the capacity of a memory for storing image data can be reduced.

Figure 13:
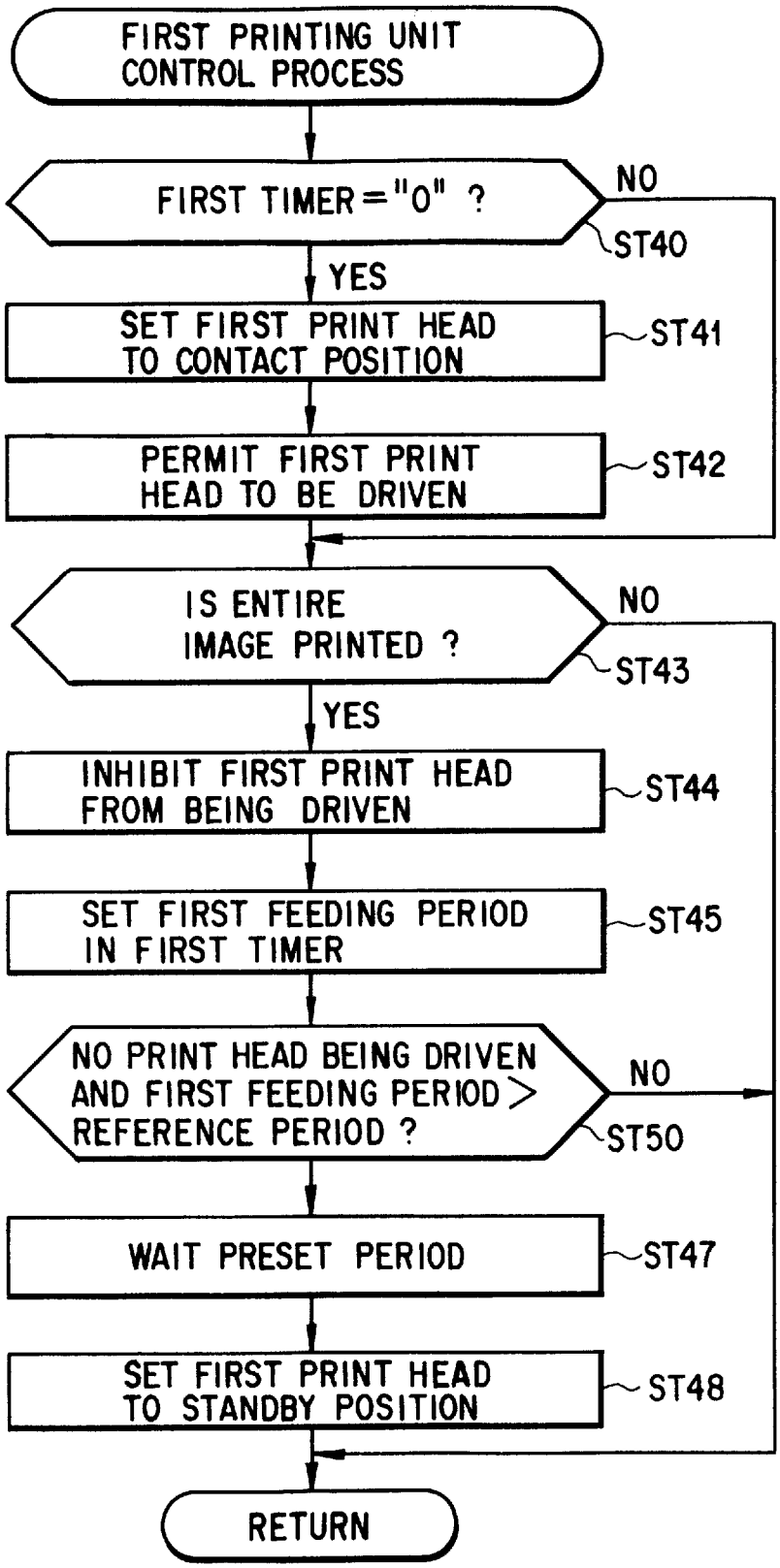
FIG. 13 is a flowchart showing a modification of the first printing unit control process shown in FIG. 10.

FIG. 13 shows a modification of the first printing unit control process shown in FIG. 10. In this modification, step ST46 shown in FIG. 10 is replaced by step ST50. In this case, the second to fourth printing unit control process are also modified in the same manner as the first printing unit control process. In step ST50, it is checked whether no print head is currently driven and the standby period is longer than a reference period obtained by adding the preset standby preparation period to a period previously confirmed to be capable of attaining an effect of saving the ink ribbons are determined.

If it is detected that that no print head is currently driven and the standby period is longer than the reference period, the first print head 11F is set to the standby position after the preset standby preparation period has elapsed. If a print head which is currently driven exists, the first print head 11F is maintained at the contact position.

According to this modification, the print head 11F is not moved from the contact position to the standby position when the print head 12F is currently driven, for example. Therefore, deterioration of the quality of the image printed by the print head 12F owning to distortion of the paper 19 as a result of the movement of the print head 11F can be prevented.

Figure 9:
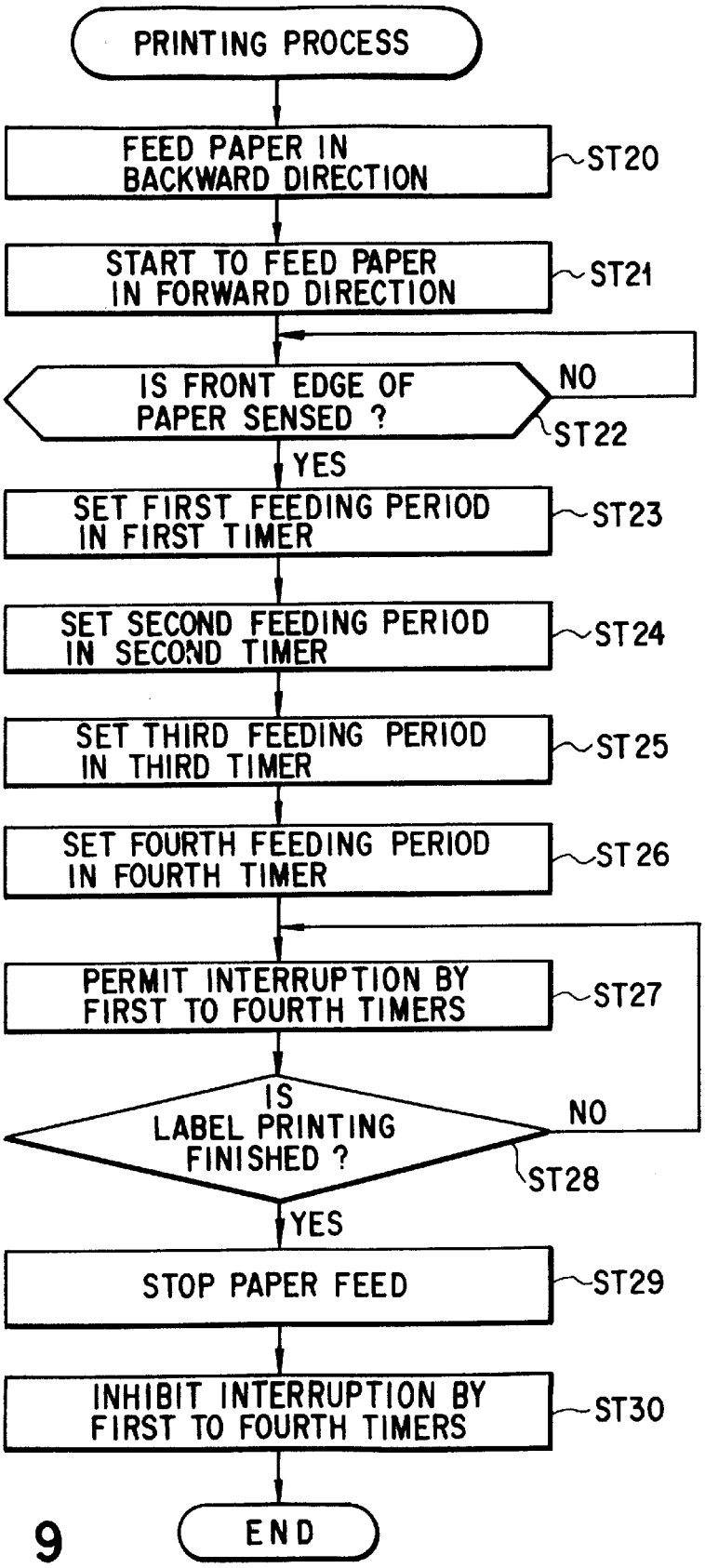
FIG. 9 is a flowchart of a printing process of an engine controller shown in FIG. 8.
Figure 14:
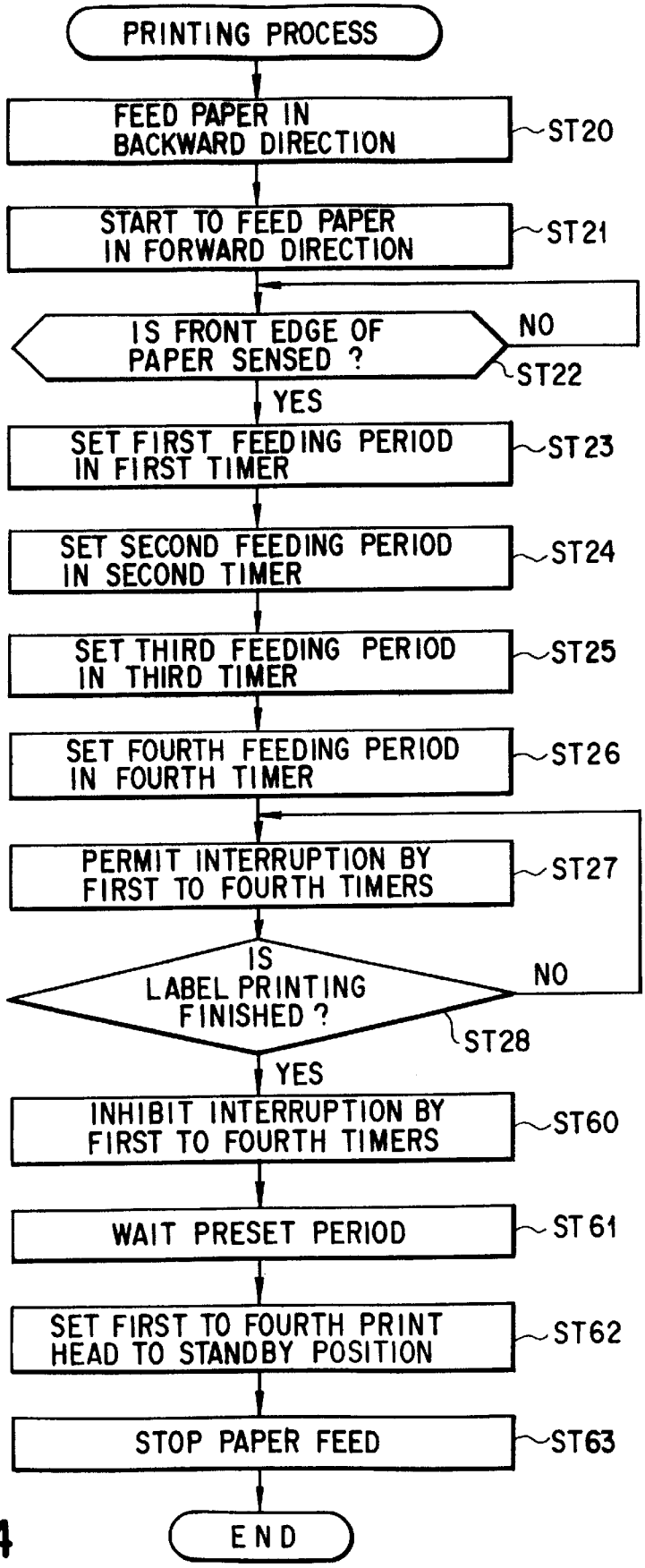
FIG. 14 is a flowchart showing a modification of the printing process shown in FIG. 9.
Figure 15:
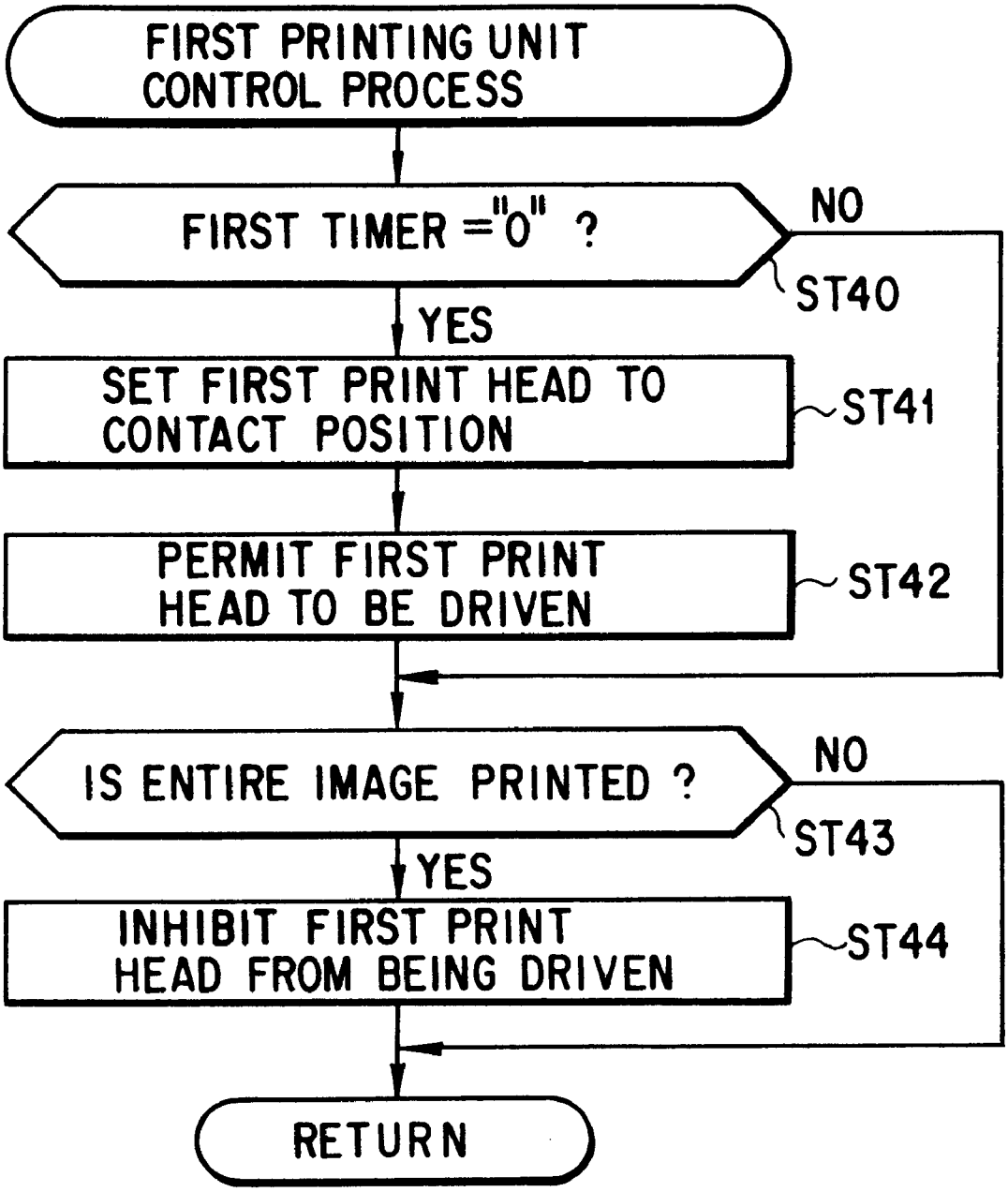
FIG. 15 is a flowchart showing a first printing unit control process performed in the printing process shown in FIG. 14.

FIG. 14 shows a modification of the printing process shown in FIG. 9. FIG. 15 shows a modification of the first printing unit control process. The first printing unit control process shown in FIG. 15 is performed in the printing process shown in FIG. 14. Steps ST29 and ST30 shown in FIG. 9 are replaced by steps ST60 to ST63 in the printing process shown in FIG. 14. Steps ST45 to ST48 shown in FIG. 10 are eliminated in the first printing unit control process shown in FIG. 15. Note that the second to fourth printing unit control processes are modified in the same manner as the first printing unit control process shown in FIG. 15.

The printing process shown in FIG. 14 will now be described. When it is detected in step ST28 that the label printing has been finished, interruptions by the timers 23, 24, 25 and 26 are inhibited. The print heads 11F, 12F, 13F and 14F are caused to wait for a predetermined preset time in step ST61, and then set to the standby position by the head lift mechanisms 11E, 12E, 13E and 14E in step ST62. Then, feeding of the paper 19 is stopped in step ST63. The printing process is terminated after execution of step ST63.

The first printing unit control process shown in FIG. 15 is terminated after driving of the thermal print head 11F has been inhibited by completing the printing interruption process in step ST44.

In the above-mentioned structure, a required number of labels are printed by the print heads 11F, 12F, 13F and 14F, and then all of the print heads 11F, 12F, 13F and 14F substantially simultaneously are moved from the contact position to the standby position.

That is, the same effects as those of the modification shown in FIG. 13 can be obtained.

The structures of the first and second embodiments will supplementarily be explained.

The feeding roller 10A is made of a material, such as rubber, having a high friction coefficient, or a metal material having projections on the surface thereof in order to raise the friction coefficient. The friction coefficient of the feeding roller 10A has a friction coefficient higher than those of the surfaces of the platens 6 to 9. Therefore, a pair of the main and sub feeding rollers 10A and 10B has a larger force for holding and moving the continuous paper 19 than the forces of the platens 6 to 9 for holding and pulling the paper 19. The feeding roller 10A is formed by using a projection roller or a spraying roller.

The feeding motors 14, 15 and 16 are formed of, for example, stepping motors. The rotational shaft of the feeding motor 14 is connected to the rotational shaft of the feeding roller 10A through a plurality of gears to control the rotation of the feeding roller 10A. The rotational shaft of the feeding motor 15 is, through a plurality of gears, connected to gears respectively attached to the rotational shafts of the platens 6 and 7 and having substantially the same gear ratio so as to control the rotations of the platens 6 and 7. The rotational shaft of the feeding motor 16 is, through a plurality of gears, connected to gears respectively attached to the rotational shafts of the platens 8 and 9 and having substantially the same gear ratio so as to control the rotations of the platens 8 and 9. The feeding roller 10A is rotated at circumferential surface speed which coincides with the feeding speed of the paper 19 determined according to the printing timings of the print heads 11F to 14F. The platens 6 to 9 have circumferential surface speed higher than the circumferential surface speed of the feeding roller 10A in order to apply the same and appropriate tensions to the paper 19. The circumferential surface speed of each of the platens 6 to 9 is adjusted by the gear ratio of a plurality of gears connected between the feeding motors 15 and 16 and the platens 6 to 9.

That is, the relationship between the circumferential surface speeds of the feeding roller 10A and the platens 6 to 8 are expressed as follows:

The speed of feeding roller 10A<the speed of platen 7=the speed of platen 8=the speed of platen 9=the speed of platen 10.

Specifically, when the feeding speed of the paper 19 is 6 inches/second, the circumferential speed of the platens 6 to 9 is set to a value higher than that of the feeding roller 10A by 4%. The value is not limited to 4%, but it is variably set depending upon the state of the surfaces (the friction coefficients) of the feeding roller 10A and the platens 6 to 9 and the feeding speed of the paper 19.

Specifically, the feeding speed of the paper 19 is slightly faster than that of the feeding roller 10A owning to the influence of the feeding forces of the platens 6 to 9. Therefore, the actual circumferential surface speed of the feeding roller 10A is set to be slightly lower than a required feeding speed of the paper 19 in consideration of the influences of the platens 6 to 9. As a result, the actual feeding speed of the paper coincides with a required feeding speed of the paper 19.

Since the surface of the feeding roller 10A has a friction coefficient larger than that of the surface of each of the platens 6 to 9, the paper 19 is pulled by the platens 6 to 9. However, the tensions obtained by the platens 6 to 9 are smaller than the feeding forces of the feeding rollers 10A and 10B. That is, the paper 19 is mainly fed by the feeding rollers 10A and 10B at the feeding speed which coincides with the circumferential surface speed of the feeding roller 10A. On the other hand, the platens 6 to 9 have circumferential surface speed higher than that of the feeding roller 10A. As a result, slippage takes place to correspond to a degree of the circumferential surface speed exceeding the circumferential surface speed of the feeding roller 10A. Therefore, an appropriate tension is applied to the continuous paper 19. Therefore, the continuous paper 19 is free from looseness or the like. The platens 6 to 9 have the same circumferential surface speed higher than the circumferential surface speed of the main feeding roller 10A and capable of applying an appropriate tension to the paper 19. As a result, the paper 19 can stable be conveyed while reliably preventing looseness.

As a result of the foregoing structure, disorder of feeding of the paper 19 can be prevented and, therefore, excellent image quality free from color deviation can be maintained.

Figure 16:
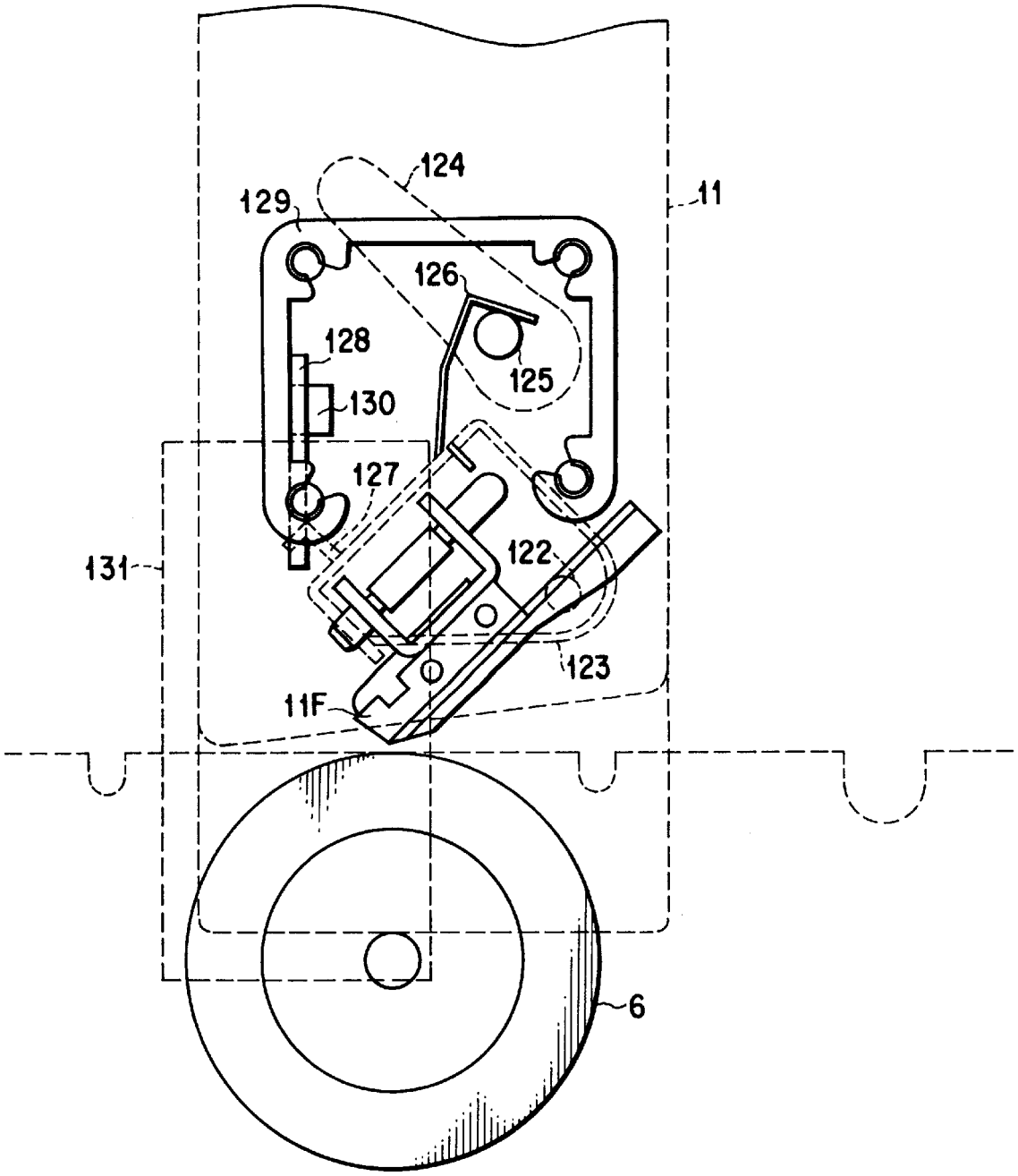
FIG. 16 is a diagram showing a modification of the head lift mechanism shown in FIGS. 3A and 3B.

The present invention is not limited to the foregoing embodiments, and a variety of modifications are permitted within the spirit of the invention. For example, the head lift mechanism shown in FIGS. 3A and 3B may be modified as shown in FIG. 16. Although description will be performed about a first printing unit 11, second to fourth printing units 12 to 14 may be structured similarly. The print head 11F is secured by a rotatable head attachment metal plate 123 having a rotation support point 122. A head pressurizing spring 126 connected to a rotational shaft 125 of a head up lever 124 is connected to the heat attachment metal plate 123. When the head up lever 124 is rotated, the head pressurizing spring 126 is rotated so that the heat attachment metal plate 123 is rotated around the rotation support point 122. As a result, the print head 11F is moved to the standby position or the contact position. FIG. 6 shows a state where the print head 11F is moved to the contact position. The heat attachment metal plate 123 has a projecting head attachment metal plate claw 127. The head attachment metal plate claw 127 is engaged to an engaging hole (not shown) of a transmission plate 128. A head block fixing frame 129 secured to the body of the printer has a transmission plate shaft 130. The transmission plate shaft 130 penetrates a rotational hole (not shown) formed in the transmission plate 128 so as to rotatablly secure the transmission plate 128 to a head block fixing frame 129. A plunger (not shown) of a self-retaining solenoid 131 is connected to an end of the transmission plate 128 opposite the rotational hole and the engaging hole. When the plunger is moved in the drawing direction, the transmission plate 128 is rotated relative to the transmission plate shaft 130. As a result, the head attachment metal plate claw 127 of the heat attachment metal plate 123 is moved upward (in a direction in which it moves apart from the platen 6) to set the print head 11F to the standby position. When the plunger is moved into the projecting direction, the head attachment metal plate claw 127 of the heat attachment metal plate 123 is moved downward (in a direction of the platen 6) to set the print head 11F to the contact position.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A printer device for a continuous printing medium having a series of printing areas, comprising:

a feeding path;

a feeding roller section for feeding the printing medium at a constant speed along said feeding path;

a plurality of platens arranged in series on said feeding path, for rotatably supporting the printing medium fed from said feeding roller section;

a plurality of print heads respectively disposed to face the platens and each print head being movable between a contact position for contact with a corresponding one of the platens and a standby position so as to be spaced apart from the corresponding platen, for performing a printing on selected printing areas of the printing medium;

a single position sensing section for sensing that the printing medium has been positioned at a printing start position located between said feeding roller section and a platen nearest said feeding roller section; and control means coupled to said print heads for determining a position of a front edge of the printing medium based on a result of measuring an elapse of time after the printing medium has been sensed to be positioned at the printing start position by said position sensing section, and moving each of said print heads from the standby position to the contact position when it is determined that the front edge of the printing medium has reached a position slightly advanced over the corresponding platen.

2. A printer device according to claim 1, wherein said control means includes a circuit for sensing an elapse of feeding time periods independently predetermined for the print heads when the printing medium has been sensed by said position sensing section to be positioned at the printing start position.

3. A printer device according to claim 2, wherein the feeding time periods are shorter than time periods required for feeding a specific part of an initial printing area nearest the front edge of the printing medium to said print heads, respectively.

4. A printer device according to claim 1, wherein said control means detects that a rear end of each printing area has passed one of the print heads, and wherein the control means returns the print head to the standby position when a time period required for feeding a next one of the printing areas to the print head is longer than a reference period.

5. A printer device according to claim 4, wherein said control means inhibits said print heads from being returned to the standby position before all the print heads have finished a printing on a same printing area.

6. A printer device according to claim 1, wherein said control means includes a plurality of print head moving mechanisms each for moving a corresponding one of said print heads between the contact position and the standby position, each head moving mechanism having a self-retaining solenoid unit comprising a cylindrical coil, a plunger and a permanent magnet.

7. A printer device according to claim 1, wherein:

said feeding roller section includes a feeding roller which rotates at a circumferential surface speed corresponding to the feeding speed of the printing medium; and wherein said control means includes platen rotating means for causing said platens to rotate at an individual circumferential surface speed which exceeds the circumferential surface speed of said feeding roller.

8. A printer device according to claim 1, wherein said position sensing section has only a single position sensor.

9. A method of controlling a printer device for printing on a continuous printing medium having a series of printing areas, wherein the printer device includes a feeding path; a plurality of platens arranged in series on said feeding path; and a plurality of print heads respectively disposed to face the platens and each print head being movable between a contact position for contact with a corresponding one of the platens and a standby position so as to be spaced apart from the corresponding platen, for performing a printing on selected printing areas of the printing medium;

the method comprising the steps of:

feeding the printing medium at a constant speed along said feeding path, said platens rotatably supporting the printing medium fed from said feeding roller section;

sensing that the printing medium has been positioned at a printing start position located between said feeding roller section and a platen nearest said feeding roller section; and determining a position of a front edge of the printing medium based on a result of measuring an elapse of time after the printing medium has been sensed to be positioned at the printing start position, and moving each of said print heads from the standby position to the contact position when it is determined that the front edge of the printing medium has reached a position slightly advanced over the corresponding platen.

10. A method according to claim 9, wherein said determining step includes sensing an elapse of feeding time periods independently predetermined for the print heads when the printing medium has been sensed to be positioned at the printing start position.

11. A method according to claim 10, wherein the feeding time periods are shorter than time periods required for feeding a specific part of an initial printing area nearest the front edge of the printing medium to said print heads, respectively.

12. A method according to claim 9, wherein said determining step detects whether a rear end of each printing area has passed one of the print heads, and returns the print head to the standby position when a time period required for feeding a next one of the printing areas to the print head is longer than a reference period.

13. A method according to claim 12, wherein said determining step inhibits said print heads from being returned to the standby position before all the print heads have finished a printing on a same printing area.

14. A method according to claim 9, wherein said determining step includes operating a plurality of print head moving mechanisms each for moving a corresponding one of said print heads between the contact position and the standby position, and wherein each print head moving mechanism includes a self-retaining solenoid unit comprising a cylindrical coil, a plunger and a permanent magnet.

15. A method according to claim 9, wherein:

said feeding step includes rotating a feeding roller at a circumferential surface speed corresponding to a feeding speed of the printing medium; and said determining step includes causing said platens to rotate at an individual circumferential surface speed which exceeds the circumferential surface speed of said feeding roller.

16. A method according to claim 9, wherein said sensing is carried out using only a single position sensor.

* * * * *